US008132619B2

(12) United States Patent
Smith, Jr. et al.

(10) Patent No.: US 8,132,619 B2
(45) Date of Patent: Mar. 13, 2012

(54) ONE TRIP LINER RUNNING, CEMENTING AND SETTING TOOL USING EXPANSION

(75) Inventors: Sidney K. Smith, Jr., Conroe, TX (US); Leopoldo S. Gomez, Humble, TX (US); Andy Tom, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 748 days.

(21) Appl. No.: 12/028,941

(22) Filed: Feb. 11, 2008

(65) Prior Publication Data

US 2009/0200040 A1 Aug. 13, 2009

(51) Int. Cl.
*E21B 43/10* (2006.01)

(52) U.S. Cl. ..... 166/207; 166/285; 166/291

(58) Field of Classification Search ..... 166/177.4, 166/207, 285, 291, 208
See application file for complete search history.

(56) References Cited

U.S. PATENT DOCUMENTS

| | | | | |
|---|---|---|---|---|
| 6,446,724 | B2 * | 9/2002 | Baugh et al. | 166/285 |
| 6,543,552 | B1 * | 4/2003 | Metcalfe et al. | 175/57 |
| 7,114,559 | B2 | 10/2006 | Sonnier et al. | |
| 7,128,146 | B2 | 10/2006 | Baugh et al. | |
| 2006/0272807 | A1 * | 12/2006 | Adam et al. | 166/207 |
| 2007/0144784 | A1 * | 6/2007 | Head et al. | 175/57 |

OTHER PUBLICATIONS

Stockmeyer, Carl F., et al., "Expanable-Drilling-Liner Technology: First Commercial Deployment of a Monobore Liner Expansion", SPE 108331. Sep. 2007, 1-10.

Stockmeyer, C.F., et al., "Development and Commercial Deployment of an Expandable Monobore Liner Extension", SPE 102150, Sep. 2008, 1-14.

Coronado, Martin P., et al., "Development of a One-Trip ECP Cement Inflation and Stage Cementing System for Open Hole Completions" IADC/SPE 39345, Mar. 1998, 473-481.

Stockmeyer, Carl F., et al., Expandable Monobore Drilling Liner Extension Technology: Applications and Implementations following the First Commercial Introduction and Development:, SPE 113901, Jun. 2008, 1-13.

* cited by examiner

*Primary Examiner* — Daniel P Stephenson
*Assistant Examiner* — Yong-Suk Ro
(74) *Attorney, Agent, or Firm* — Steve Rosenblatt

(57) ABSTRACT

A tool allows in a single trip advancing the liner while more hole is made until the liner is properly positioned. Slips are actuated into the inside of the liner to grasp it as a swage is released to move to support the liner to the surrounding tubular. With the liner supported in the hole, the running tool can be picked up to test the release feature and then set down again for cementing. The tool is then picked up higher to release a flapper and re-pressurized to set a seal adjacent the support previously engaged by swage operation. The flapper has a rupture disc blown and the tool is removed. The tool has an emergency release.

21 Claims, 57 Drawing Sheets

ONE TRIP LINER RUNNING, CEMENTING AND SETTING TOOL USING EXPANSION

FIELD OF THE INVENTION

The field of this invention is one trip systems and tools that allow a liner to be run in while drilling and supported by expansion to a surrounding tubular for support so that cementing can take place after a positive indication that release from a mandrel is possible to then allow a seal to engage by further expansion.

BACKGROUND OF THE INVENTION

Liners have been run in as more hole is being made beyond existing casing. The bit is secured to the lower end of the liner and the liner is rotated with a drill string that includes a running tool that grips the liner to rotate it to make more hole. When the liner is properly positioned it can be cemented through the bit that is ultimately milled out to make even more hole. The running tool that supports the liner had a feature that allowed it to be released from the liner after the liner weight was shifted to the surrounding casing. This was a good feature in the tool as it told the operator at the surface, before the cement was pumped that the running tool could be released from the liner before the liner was cemented. After this indication, the cementing took place and pressure built on the wiper plug that was dropped after the cement was pumped to set a seal. While this was done in a single trip, it did not involve liner expansion.

With the advent of expansion of liners came techniques of running the liner while drilling. When it came time to support the liner so that it could be cemented the tools available had no provision for a release of the running tool from the liner after the liner was expanded into a supported position against the surrounding tubular. In essence, the task of supporting and sealing the liner to the surrounding tubular took place without the knowledge if the release of the running tool was possible. The cementing job commenced with the possibility that the cement could set up in the region of the release mechanism for the running tool and thus prevent release of the running tool with the liner now cemented in position. If the running tool could not then release the well could become a total loss or at minimum necessitate a time consuming and expensive procedure to try to salvage the well so that is could be fully completed and ultimately produced.

What is needed and is provided by the present invention is a one trip system for running in a liner while drilling where the liner can be supported by expansion and then tested for release of the running tool from the now supported liner. If the running tool releases, weight is set down and the liner is cemented. After cementing, the running tool is lifted again to allow the mandrel to again be closed so that another application of pressure allows a piston or stacked pistons to advance a swage assembly yet again to expand a seal into contact with the surrounding tubular. The tool can then be removed from the fully supported and sealed liner that has already been cemented. An emergency release can be actuated by rotating to the right to release slips that hold the tool to the inside of the liner. The tool is arranged so that an actuating piston for a slip assembly is in pressure balance before a ball is seated regardless of whether the packoff for the annulus between the tool mandrel and the liner is below the swage as in the larger sizes or above the swage as in the smaller sizes. Mechanisms are provided in the larger sizes to block a pressure balance passage when the actuating piston for the slips to retain the tool to the liner is needed for a second stroke to actuate the seal after the cementing. Provisions are made to open the mandrel passage after the seal is set by expansion so that a wet string is not pulled. These and other aspects of the present invention will be more readily understood by a review of the various embodiments described below when reviewed with their associated drawings while recognizing that the full scope of the invention is determined by the appended claims.

SUMMARY OF THE INVENTION

A tool is provided that allows in a single trip advancing the liner while more hole is made until the liner is properly positioned. Slips are actuated into the inside of the liner to grasp it as a swage is released to move to support the liner to the surrounding tubular. With the liner supported in the hole, the running tool can be picked up to test the release feature and then set down again for cementing. The tool is then picked up higher to release a flapper and re-pressurized to set a seal adjacent the support previously engaged by swage operation. The flapper has a rupture disc blown and the tool is removed. An emergency release is provided.

DETAILED DESCRIPTION OF THE PREFERRED EMBODIMENT

Figure 1A:
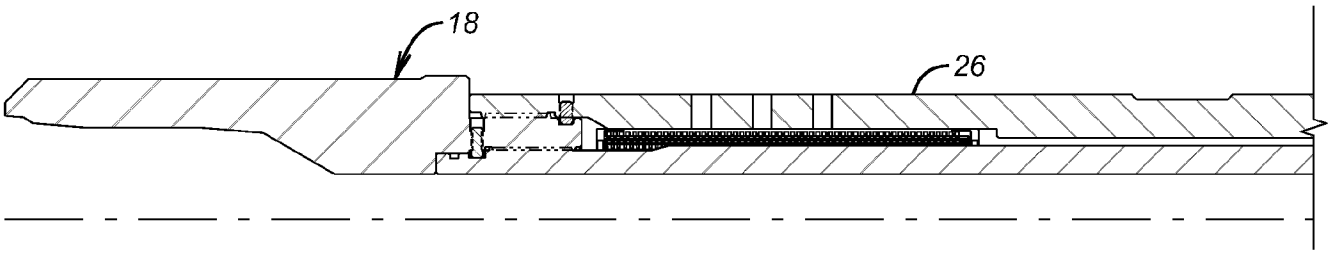
FIG. 1*a*-1*i* shows the tool and associated liner in section and in the run in position.
Figure 2A:
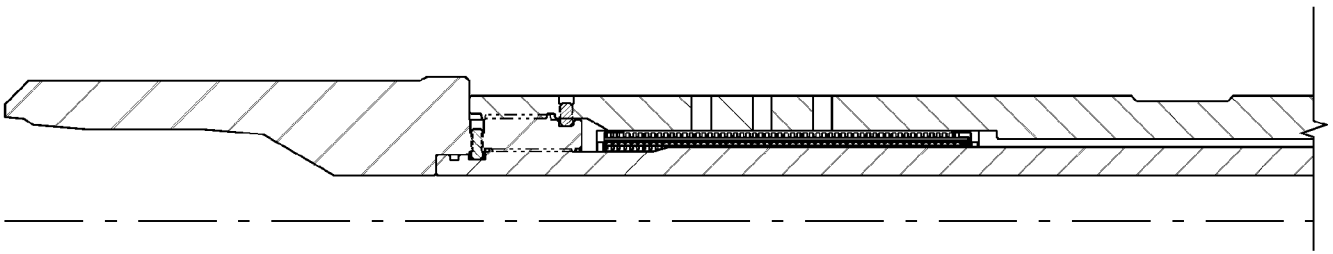
FIGS. 2*a*-2*i* show the same tool in the position with the slips grabbing the inside of the liner and the swage stroked to hang the liner.
Figure 3A:
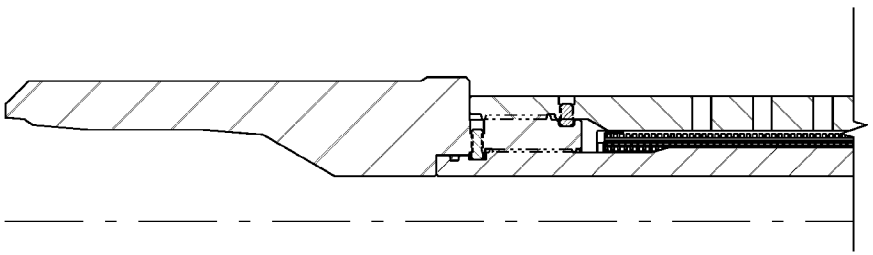
FIGS. 3*a*-3*i* show the same tool with the ball blown through the seat.
Figure 1B:
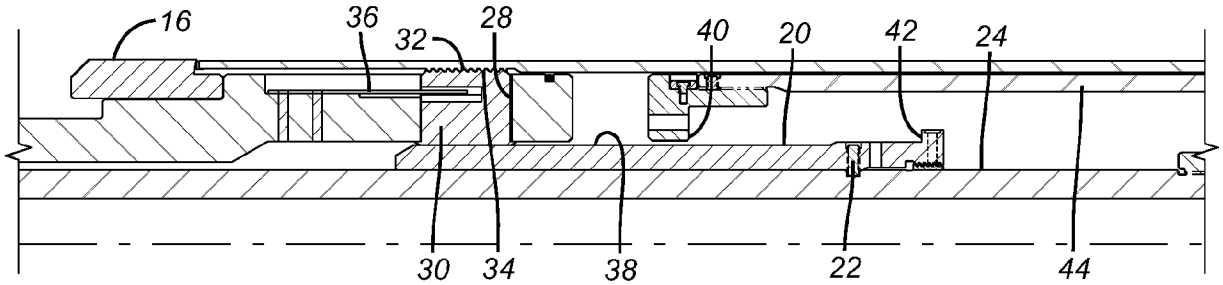
Figure 1C:
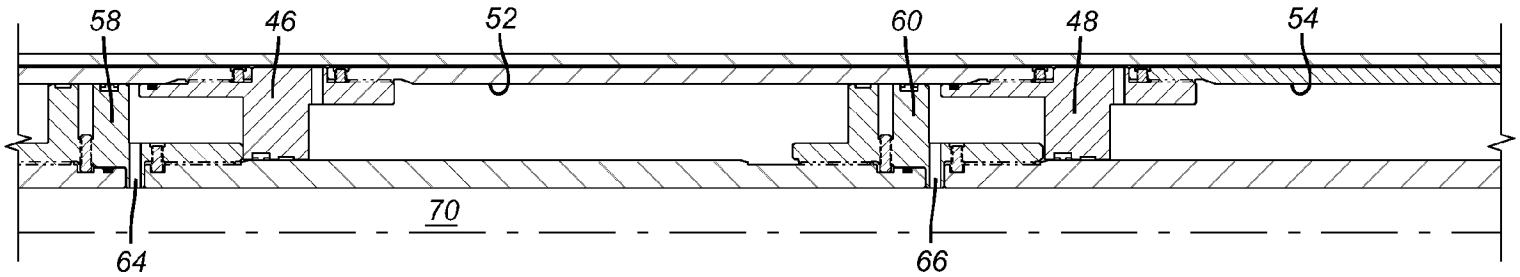
Figure 1D:
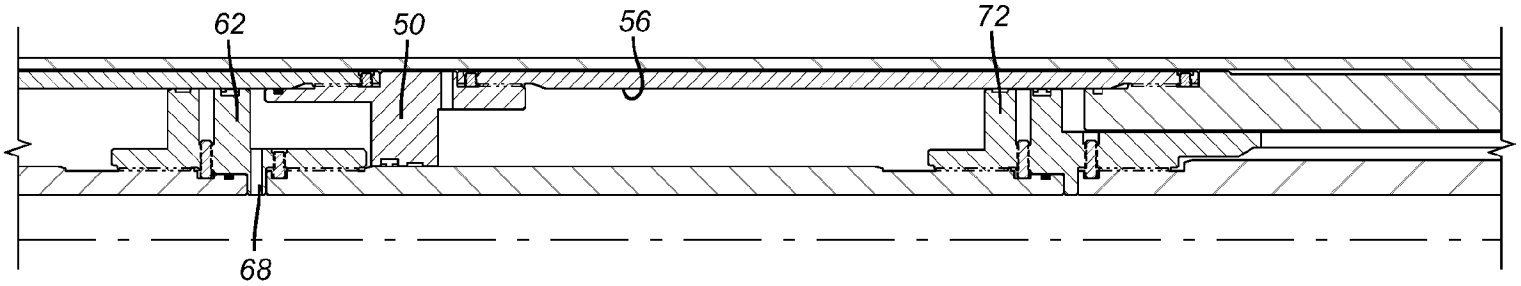
Figure 1E:
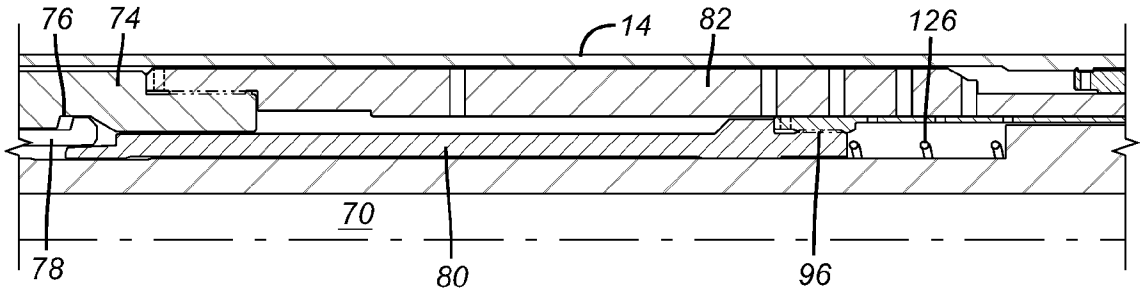
Figure 1F:
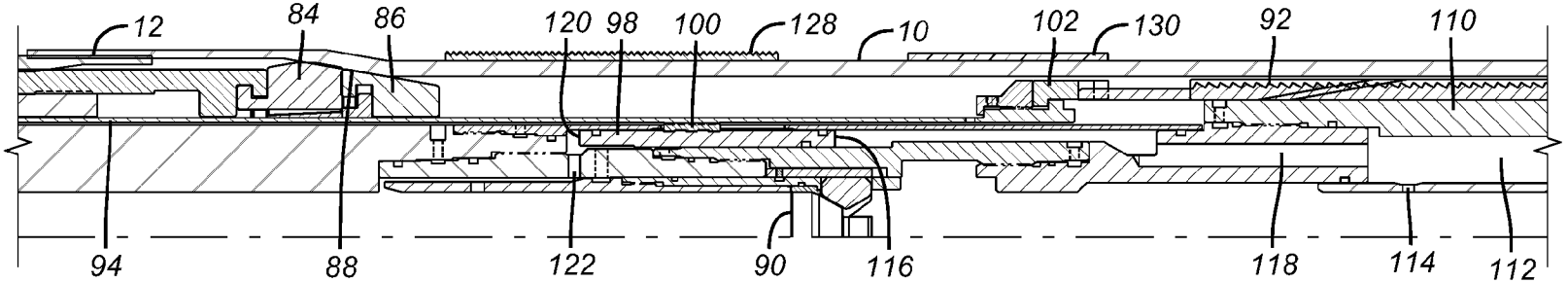
Figure 1G:
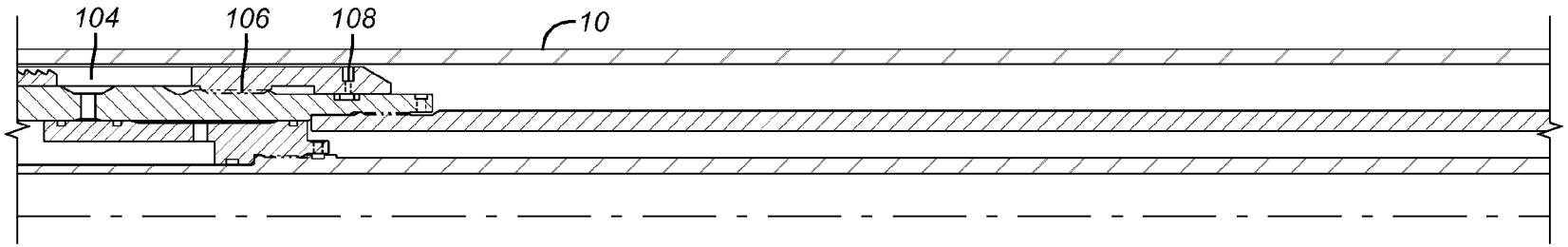
Figure 2G:
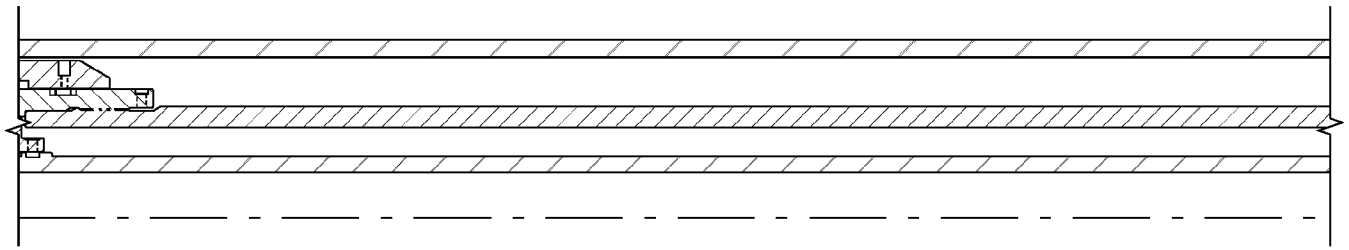
Figure 1H:
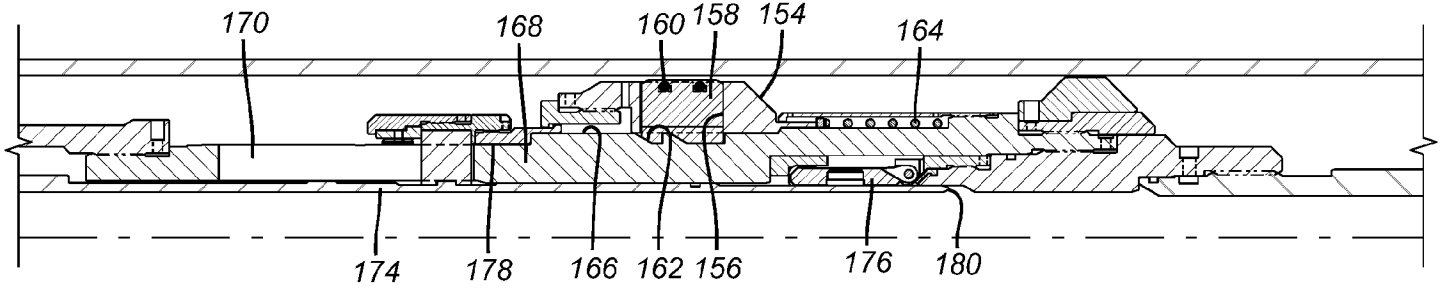
Figure 2H:
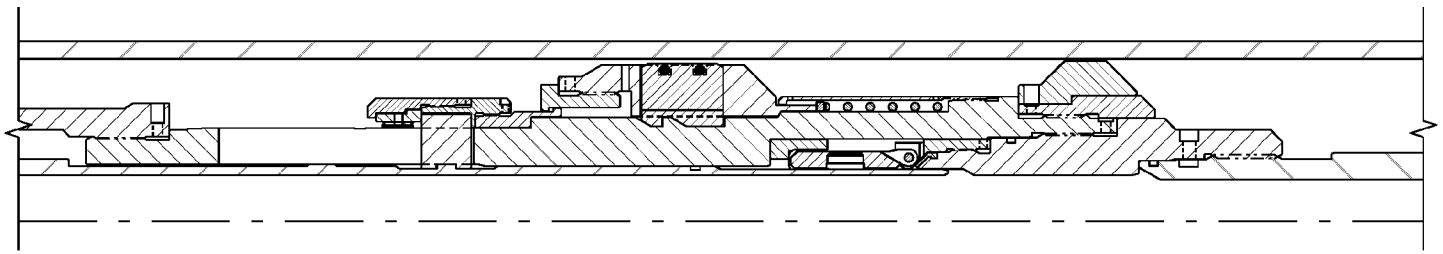
Figure 3H:
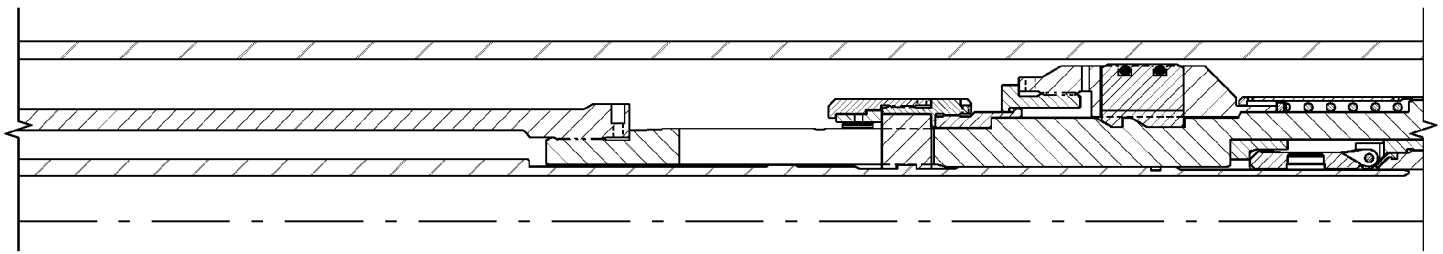
Figure 1I:
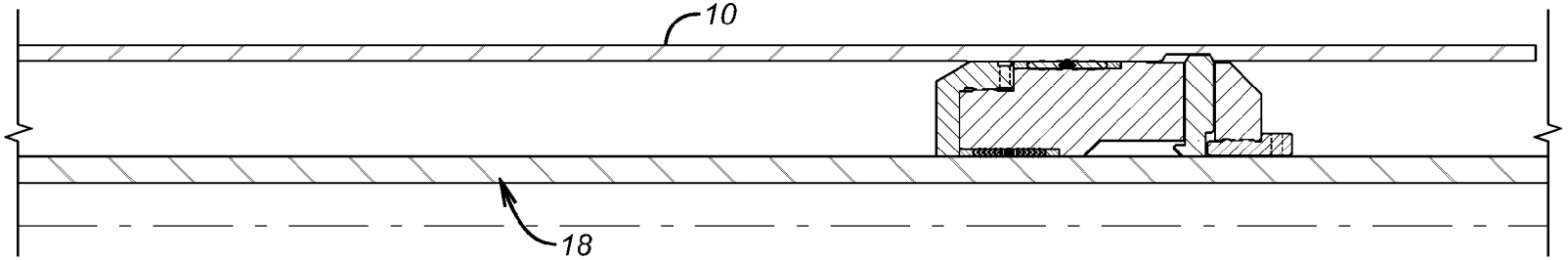
Figure 2I:
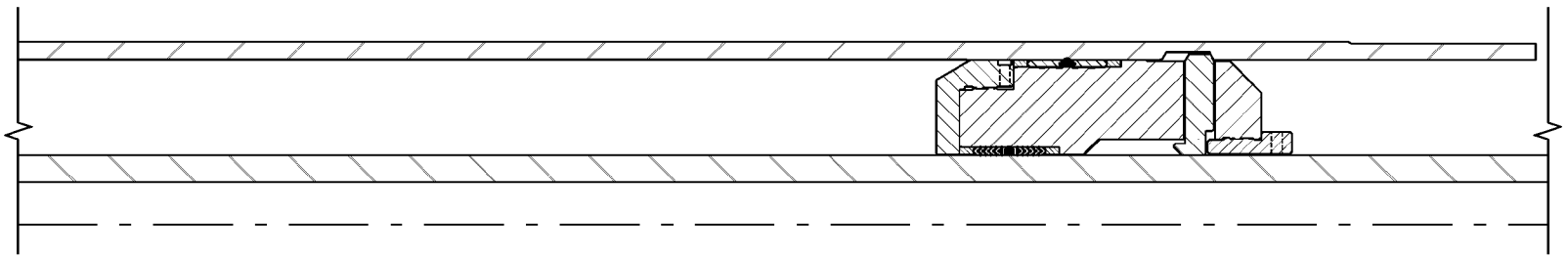
Figure 3I:
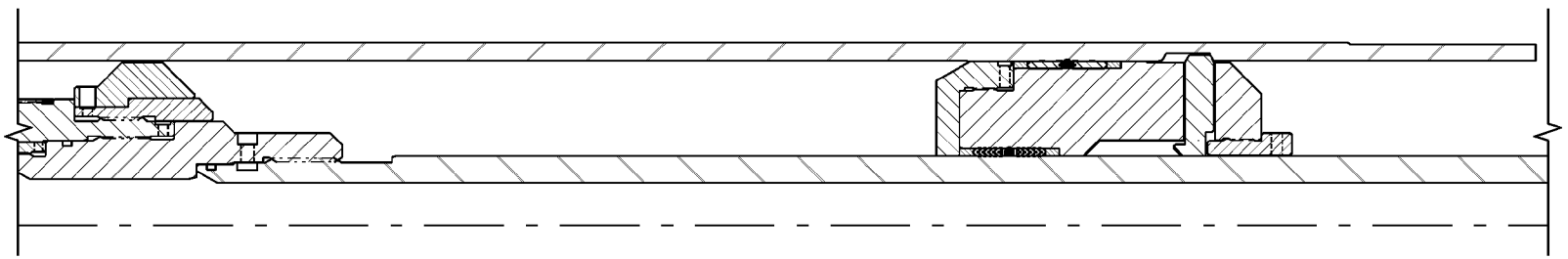

Going from the downhole end at FIG. 1*i* the liner 10 extends to thread 12 in FIG. 1*f* and from there an upper extension 14 goes up to a support ring 16 in FIG. 1*b*. A mandrel assembly 18 extends from FIG. 1*a* at the uphole end to beyond the end of the drawing on the downhole end 1*i*. The portions below FIG. 1*i* are known components used in drilling such as a bit and cementing such as a wiper plug dropper and a landing collar for the plugs launched before and after the cement is pumped. These and other equipment not essential for a clear understanding of the invention have been eliminated from the FIGS. to focus the presentation on the features of the invention while relying on the knowledge of those skilled in the art for the drilling and cementing-related equipment disposed on the mandrel assembly 18 below FIG. 1*i*.

Figure 2B:
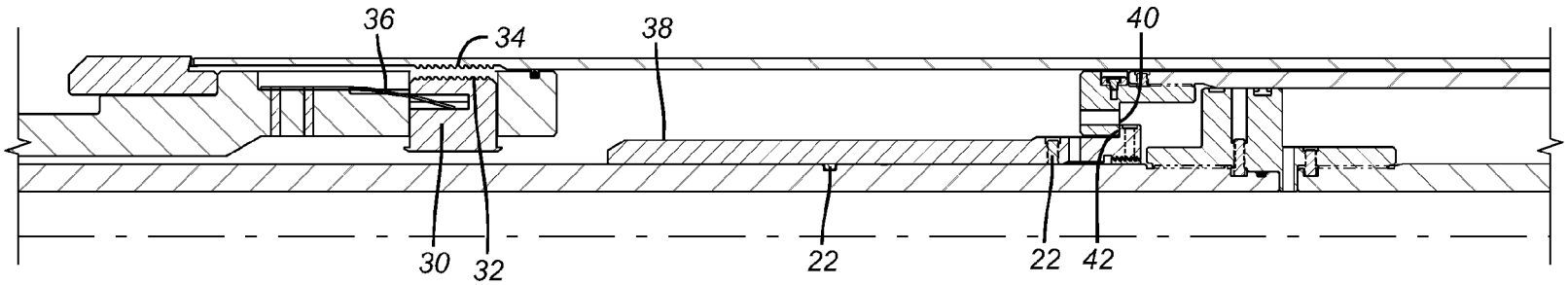
Figure 3B:
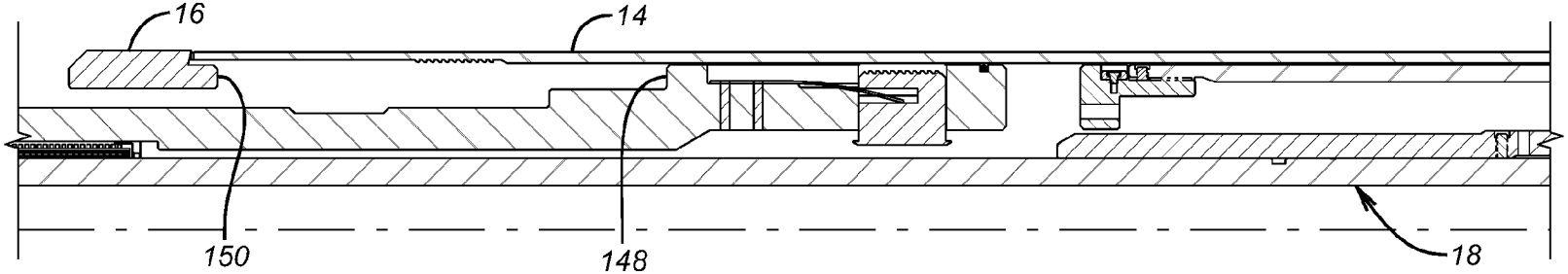
Figure 2C:
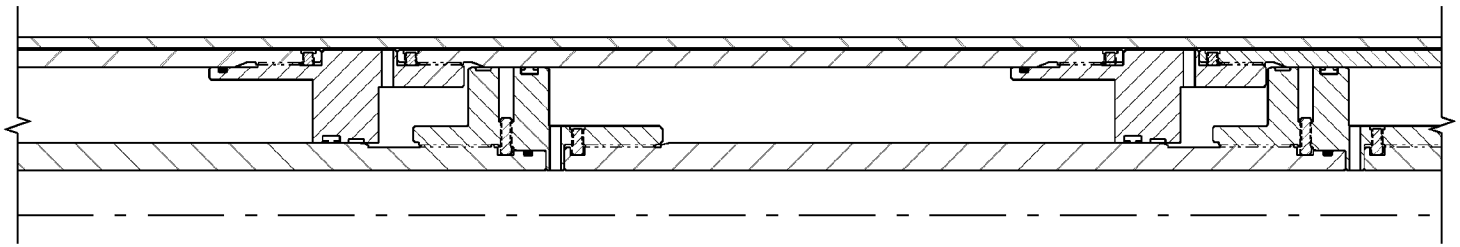
Figure 3C:
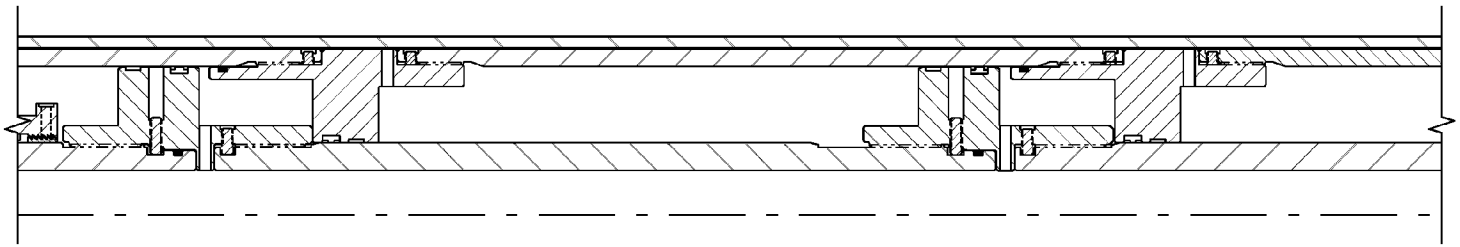

The initial support of the upper extension 14 by the mandrel assembly 18 will now be explained. A sleeve 20 is secured by a shear pin 22 in FIG. 1*b* to surface 24 of mandrel assembly 18. An outer sleeve 26 forms a part of mandrel assembly 18 and has a window 28 in which sits a dog or dogs 30 having an external profile 32 that mates with profile 34 on the liner upper extension 14. A leaf spring 36 extends from sleeve 26 into each dog 30 to retain it in the window 28 after support for dogs 30 is undermined as shown in FIG. 2*b* when sleeve 20 is grabbed by shoulder 40 hitting shoulder 42 on sleeve 20 to break the shear pin 22 and move surface 38 out from under dogs 30.

Figure 2D:
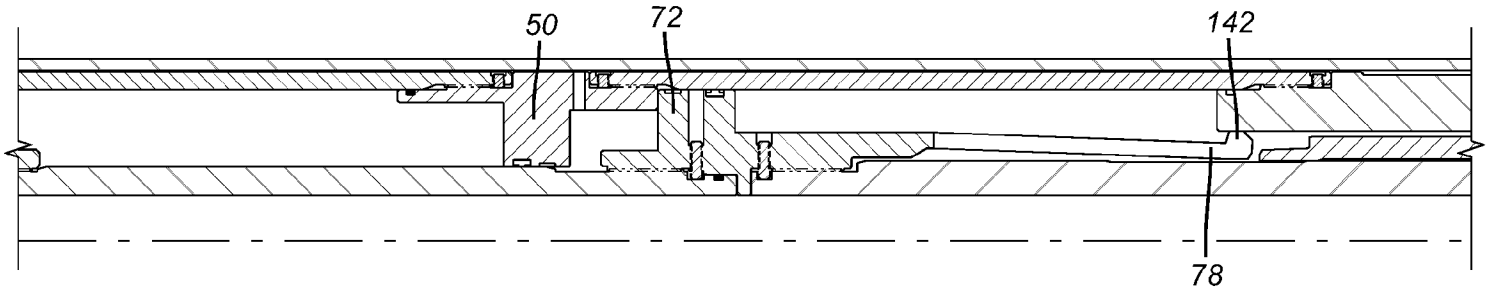
Figure 2E:
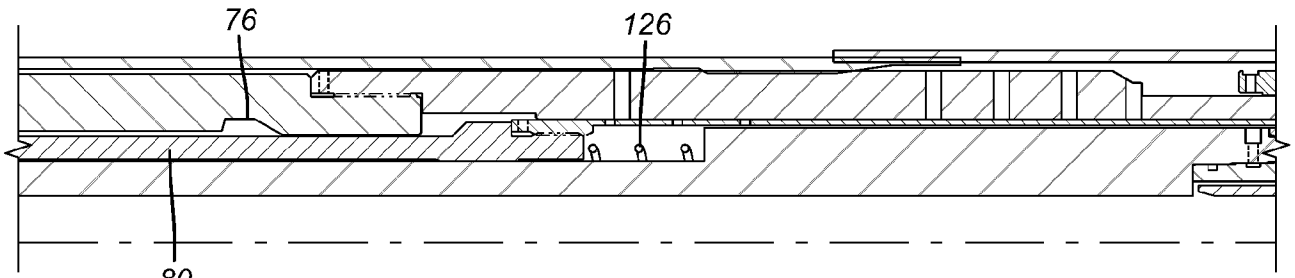

The swage and the force multiplying pistons will not be discussed. Shoulder 40 is a part of sleeve 44. Sleeve 44 is illustratively attached to three pistons held together for tandem movement although fewer or more pistons can be used. The pistons are 46, 48 and 50 and they are spaced from each other with sleeves 52, 54 and 56. Pressure chambers 58, 60 and 62 are accessed from passages 64, 66 and 68 from mandrel passage 70. A travel stop 72 shown in FIG. 1*d* marks the end of the travel length of the pistons 46, 48 and 50 when piston 50 bumps the stop 72 as shown in FIG. 2*d*. Continuing downhole from sleeve 56 in FIG. 1*d*, a latch sleeve 74 has a groove 76 into which a collet 78 is held when the collet 78 is supported by a sleeve 80. Collet 78 is part of the mandrel assembly 18 and is secured near travel stop 72. Latch sleeve 74 is connected to sleeve assembly 82 below which is mounted a variable diameter swage 84 of a type known in the art such as U.S. Pat. Nos. 7,128,146 and 7,114,559 and below that is a fixed swage 86 that rests on taper 88 in the liner 10 as shown in FIG. 1*f*. It should be noted here that until the assembly that is topped by sleeve 80 moves from the FIG. 1*e* to the FIG. 2*e* position, the pistons 46, 48 and 50 cannot stroke. The assembly topped by sleeve 80 is in pressure balance to pressure in passage 70 with no ball blocking seat 90, as will be explained below.

Figure 2F:
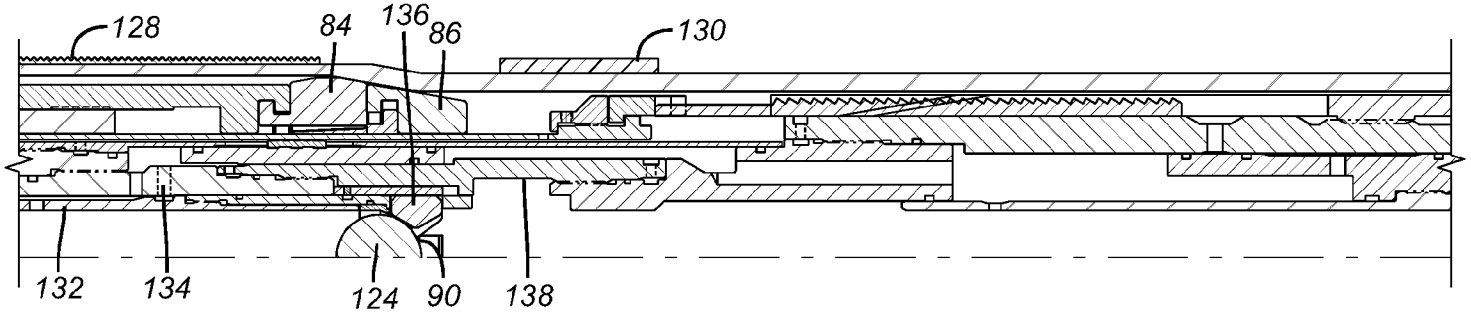

The actuating piston assembly topped by sleeve 80 and extending down to slips 92 in FIGS. 1*f*-1*g* will now be explained. Sleeve 80 is connected to sleeve 94 at thread 96. Sleeve 94 is coupled to piston 98 at lug 100. Sleeve 94 is connected to slip ring 102 which when moved forces slips 92 radially outwardly along cone 104. Cone 104 is secured by left hand thread 106 and shear pin 108 to sleeve 110, which is part of the mandrel assembly 18. Left hand thread 106 acts as an emergency release when the mandrel assembly is rotated to the right to back away cone 104 from slips 92 when they are against the inside of the liner 10, as will be explained later. A chamber 112 has access to passage 70 through port or ports 114. Pressure on the lower surface 116 of piston 98 communicates to ports 114 through passage 118. Piston 98 has an upper surface 120 that has exposure to passage 70, through passage 122, and is the same dimension as bottom surface 116 to put the piston 98 in pressure balance with no ball on seat 90. Ports 114 can be closed for the purpose of putting piston 98 in a pressure imbalance so that applied pressure in passage 70 will move slips 92 along cone 104 to grip the inside of liner 10 in a manner that will be described below. By way of foreshadowing, piston 98 is also placed in a pressure imbalance to passage 70 for an initial grip of slips 92 of the inside of liner 10 so that the swages 86 and 84 can advance when pistons 46, 48 and 50 are stroked because the mandrel assembly 18 is braced to the inside of the liner 10 when a ball 124 is dropped onto seat 90 as shown in FIG. 2*f*. Downhole movement of piston 98 takes with it sleeve 80 and compresses spring 126 in the FIG. 2*e* position as will be explained.

A grip anchor ring 128 is placed outside of liner 10 adjacent to a seal assembly 130. As seen from comparing FIGS. 1*f* and 2*f*, the anchor ring is expanded first against the surrounding tubular (not shown) to support the liner 10 to it. The swages 86 and 84 are re-stroked after a few other movements to later expand the seal assembly 130 against the surrounding tubular (not shown) as will be explained below.

Figure 3D:
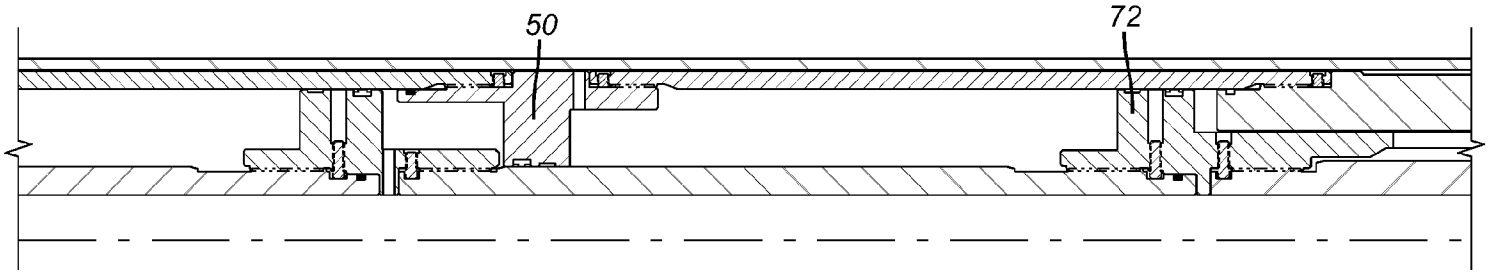
Figure 3E:
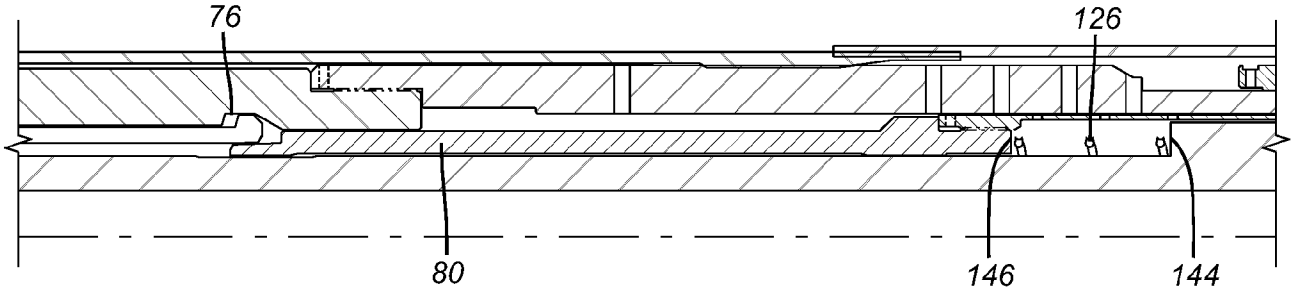

At this time the initial expansion of the liner 10 into the surrounding tubular to set anchor grip ring 128 will be described. As shown in FIG. 2*f* seat 90 is a part of sleeve 132 shear pinned to the mandrel assembly 18 with pins 134. The seat 90 has backup segments 136 also supported by the sleeve 132 against the mandrel assembly 18. Ultimately, when a ball 124 lands and allows pressure above it in passage 70 initiate expansion of liner 10, there is also some higher pressure level after pistons 46, 48 and 50 are against a stop 72 that will shear pins 134 and force sleeve 132 to slide until the segments 136 align with recess 138 in mandrel assembly 18 and the seat 90 is undermined so that the ball 124 can blow through the seat 90 as shown in FIG. 3*g*.

Continuing now with the sequence of events from when ball 124 lands on seat 90, the first thing that happens is pressure is built up in passage 70 above ball 124 with piston 98 now in a pressure unbalanced condition. The applied pressure moves everything downhole from the slips 92 at the lower end to the sleeve 80 at the upper end. Slips 92 ride up cone 104 until they embed into the inside wall of liner 10 for a firm grip. That same movement takes sleeve 80 out from under collets 78. With the collets 78 no longer latched to groove 76 the pressure in passage 70 now can move the pistons 46, 48 and 50 to advance the swages 86 and 84 to secure the anchor ring 128 that is outside the liner 10 to the surrounding tubular (not shown). The liner 10 is now supported off the surrounding tubular and because the movement of pistons 46, 48 and 50 has taken with them sleeve 44 the shoulder 40 has engaged shoulder 42 on sleeve 38 the dogs 30 are undermined and the shear pins 22 are broken. Spring 36 holds dogs 30 in FIG. 2*b* with the profiles 32 and 34 no longer engaged. The mandrel assembly 18 is now released from the independently supported liner 10.

Figure 3F:
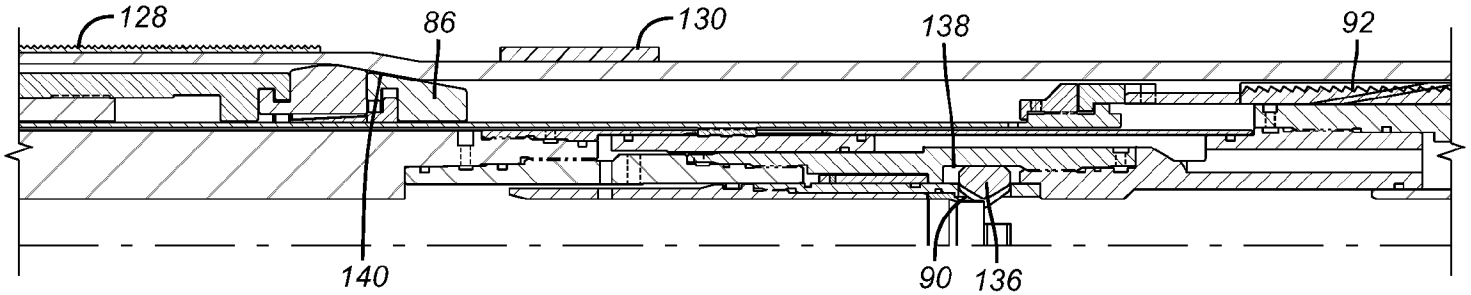
Figure 3G:
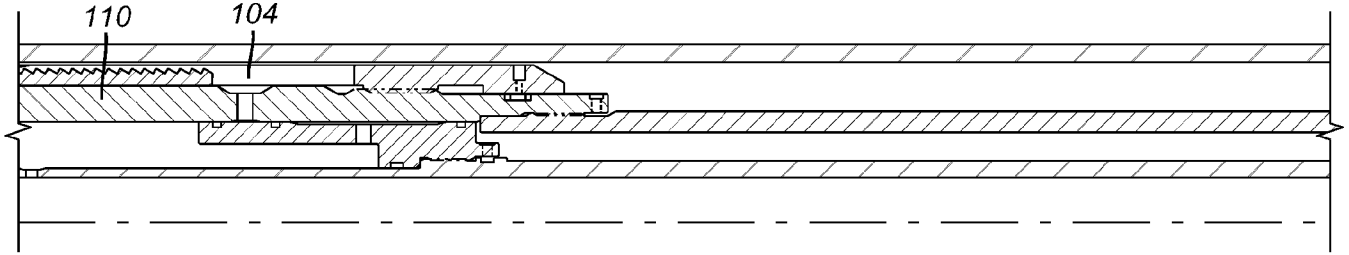

A further pressure buildup with the pistons 46, 48 and 50 no longer able to move has the result of using ball 124 to shift sleeve 132 to undermine seat 90 as previously described so that ball 124 is blown through it as shown in FIG. 3*f*. Weight is then set down on the mandrel assembly 18 with fixed swage 86 landed on taper 140 created from the stroking of pistons 46, 48 and 50 which results in resumption of the piston position with respect to stop 72 from the FIG. 2*d* position back to the same relative position in FIG. 3*d* that existed for run in at FIG. 1*d*. In effect the pistons 46, 48 and 50 are re-cocked for another stroke.

During this setting down of weight, other things are happening. One is that the pistons get re-latched. When weight is set down on the mandrel assembly 18 in FIG. 3 the collets 78 begin their movement in FIG. 2*d* trapped above sleeve 80. Collets 78 displace sleeve 80 against the bias of spring 126 until the collet heads 142 align with groove 76 allowing them to flex radially out to allow sleeve 80 under the bias of spring 126 to get under heads 142 and trap them to groove 76 as shown in FIG. 3*e*.

Referring now to FIG. 3*g*, the setting down weight on mandrel assembly 18 also moves down sleeve 110 taking cone 104 out from under slips 92 allowing them to release their grip of the inside of the liner 10 with an assist in uphole movement by the aid of spring 126 bearing on surface 144 on mandrel assembly 18 and pushing against surface 146 of the assembly the extends from sleeve 80 down to slips 92 and including piston 98.

Figure 4A:
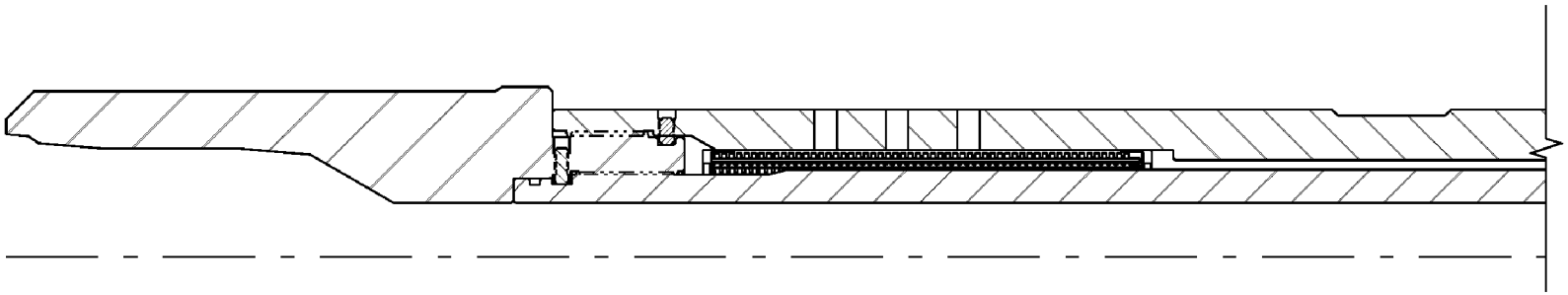
FIGS. 4*a*-4*i* show the same tool picked up to confirm release of the running tool.
Figure 5A:
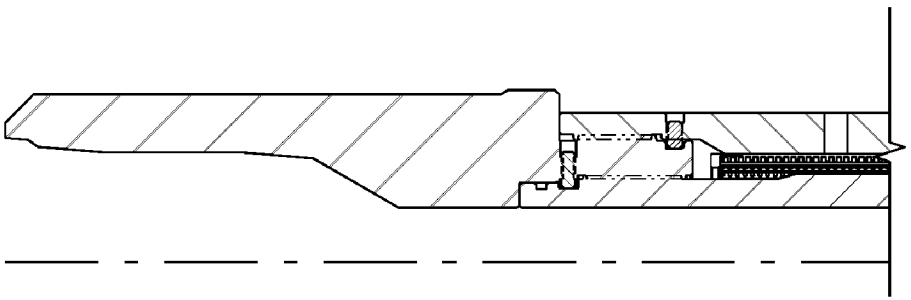
FIGS. 5*a*-5*i* shows the same tool in the set down to cement position.
Figure 4B:
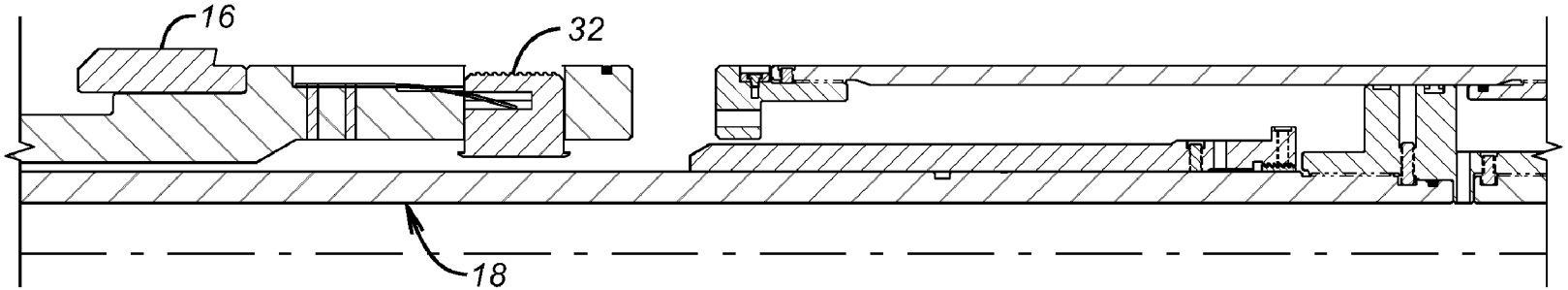
Figure 4C:
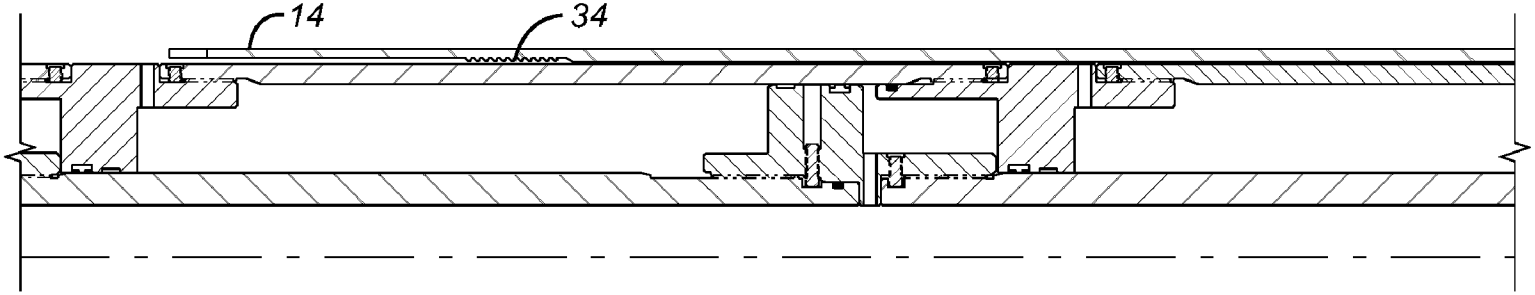
Figure 4D:
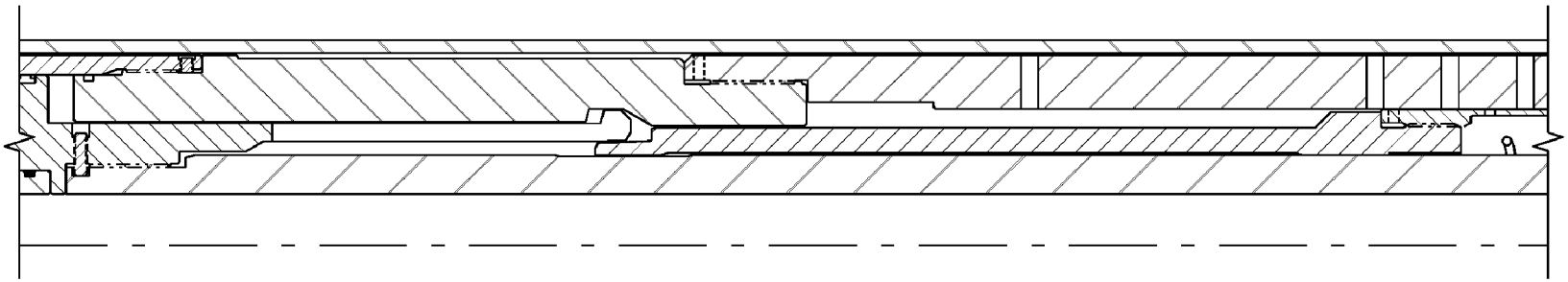
Figure 4E:
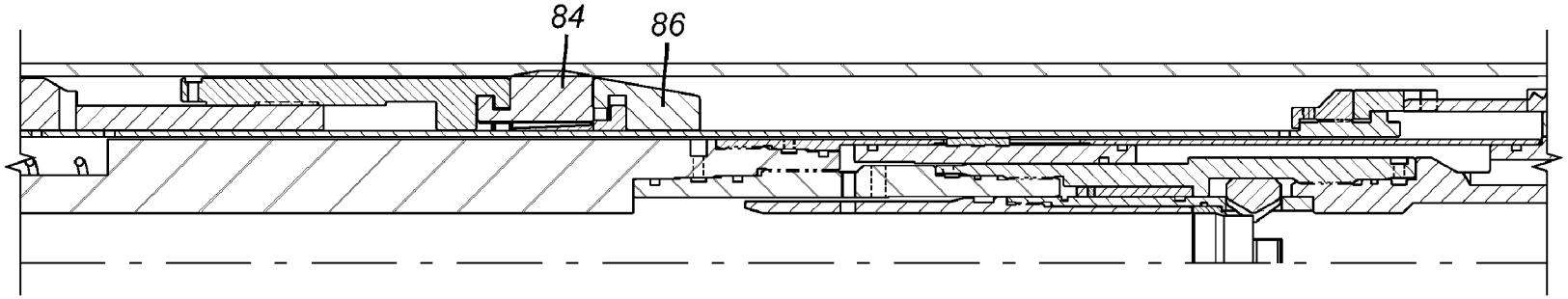
Figure 4F:
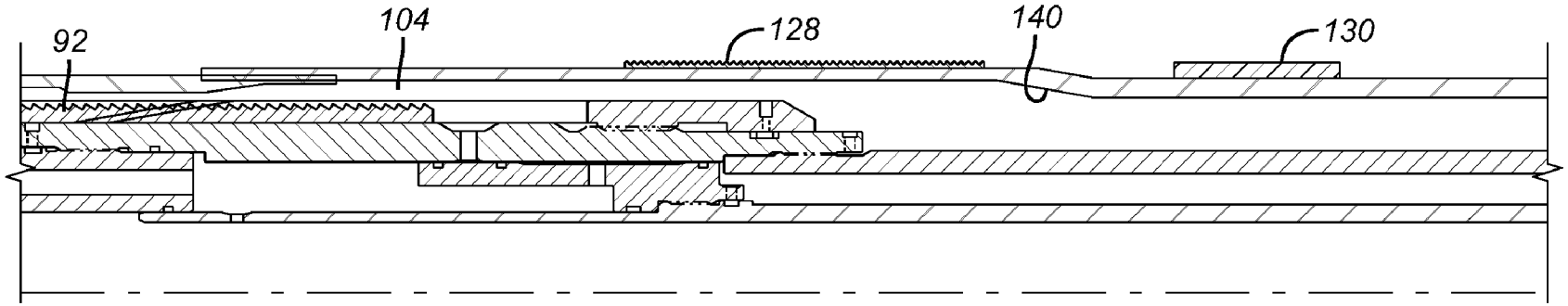
Figure 4G:
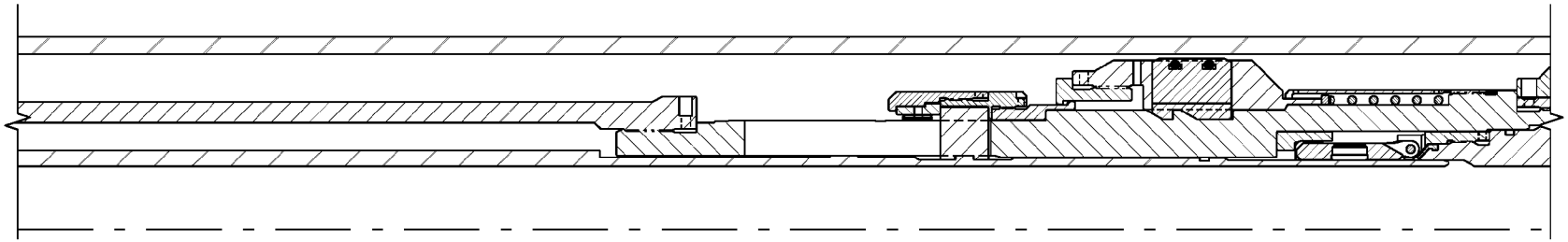
Figure 4H:
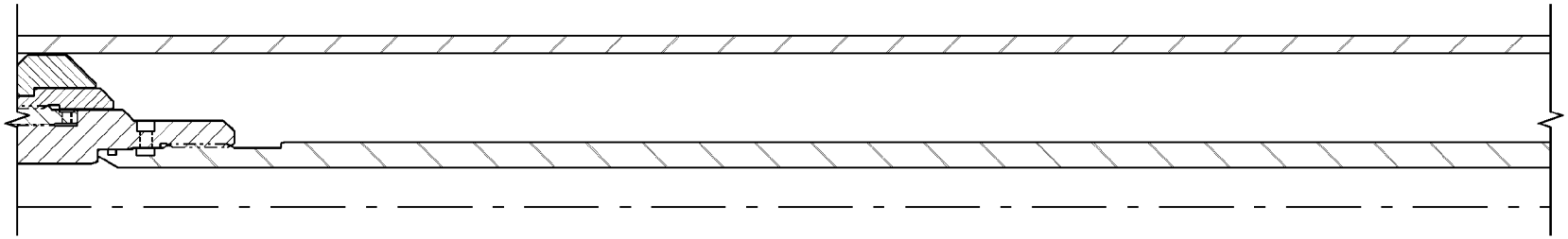

At this time it is a pickup force that is applied to test if the dogs 30 have released profile 32 from profile 34 as shown in FIGS. 4*a-c*. A pick up force that meets little resistance is indicative of such a release. Note that the swages 86 and 84 have come up and away from taper 140 in liner 10 because the previous setting down weight on the mandrel assembly 18 undermined the grip of slips 92 on the inside of the now supported liner 10 by pushing cone 104 down and away from slips 92. A pickup of a preferred distance of five feet is sufficient to give the surface signal that the mandrel assembly 18 is dislodged from liner 10 at the liner profile. Note also from FIG. 3*b* that a subsequent pick up force will bring shoulder 148 against shoulder 150 of support ring 16 severing it from liner extension 14 and retaining it to the mandrel assembly 18 as shown in FIGS. 4*a*-4*c*.

Figure 5B:
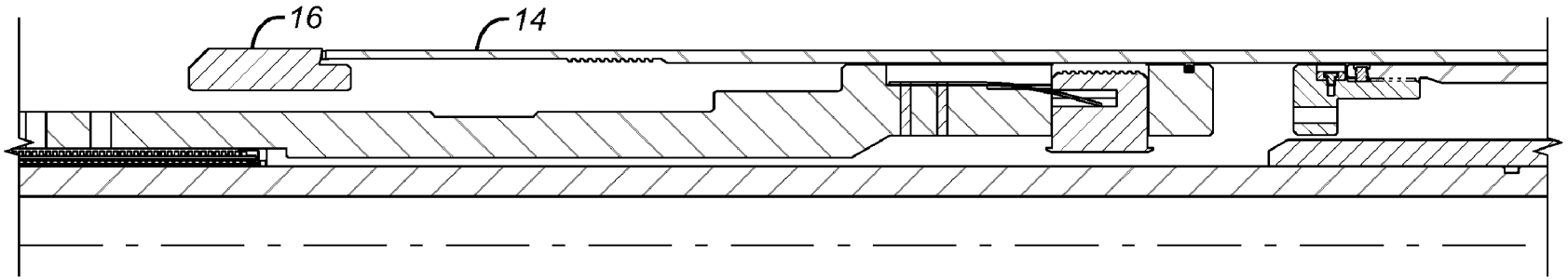

At this time the cementing step can take place after again setting down weight on mandrel assembly 18 until swage 86 again rests on taper 140 as shown in FIGS. 5*a*-5*f*. Note that setting down weight has landed support ring 16 back on top of liner extension 14 as shown in FIG. 5*b*.

Figure 5C:
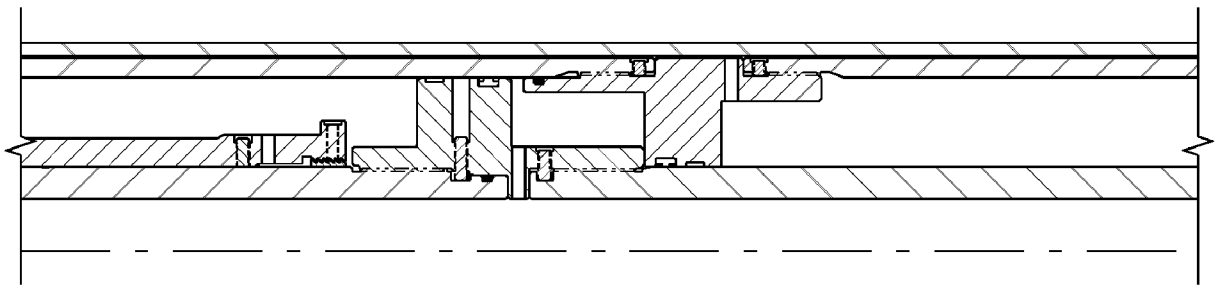
Figure 5D:
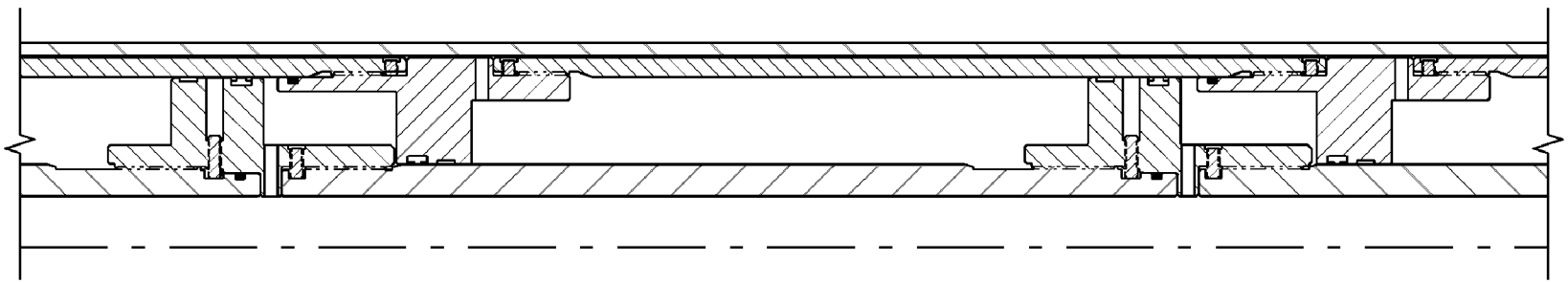
Figure 5E:
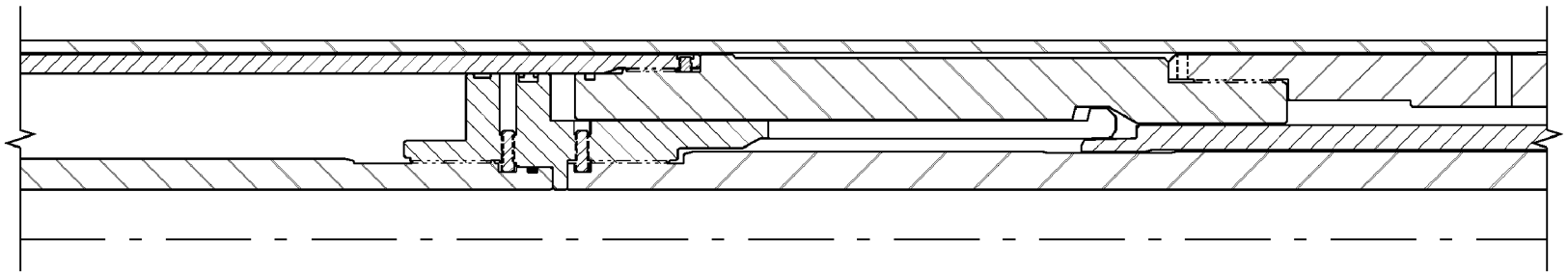
Figure 5F:
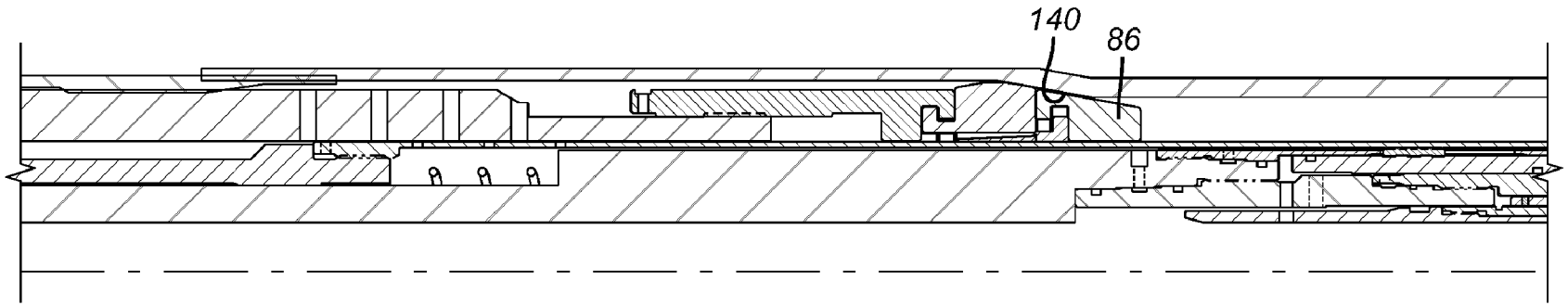
Figure 5G:
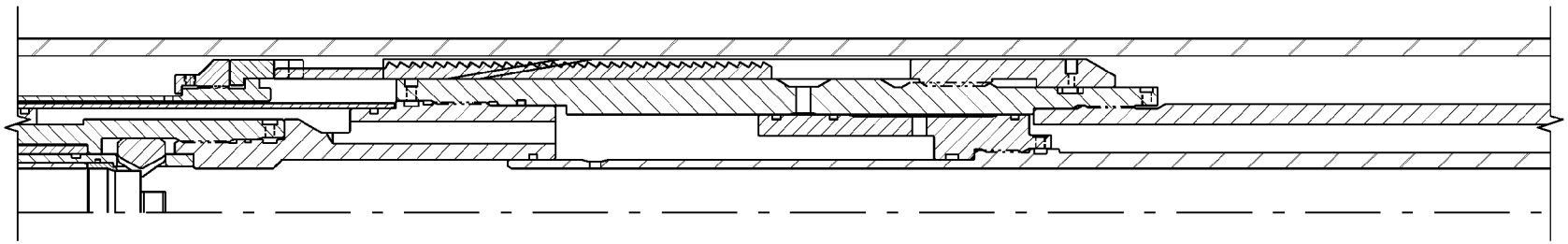
Figure 5H:
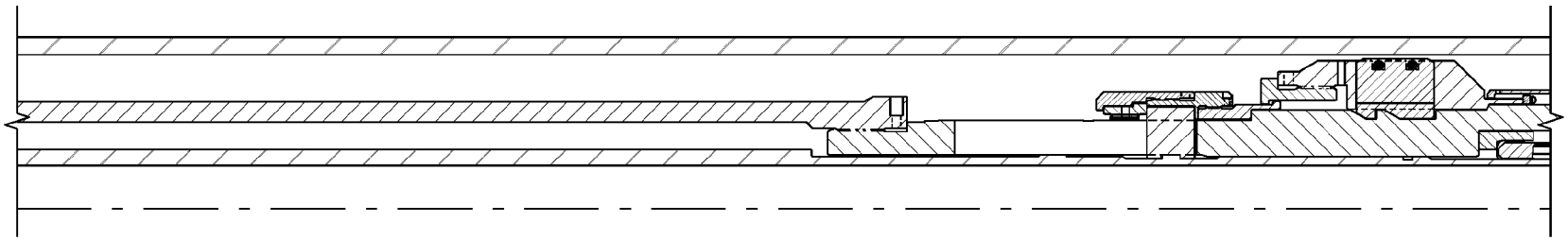
Figure 4I:
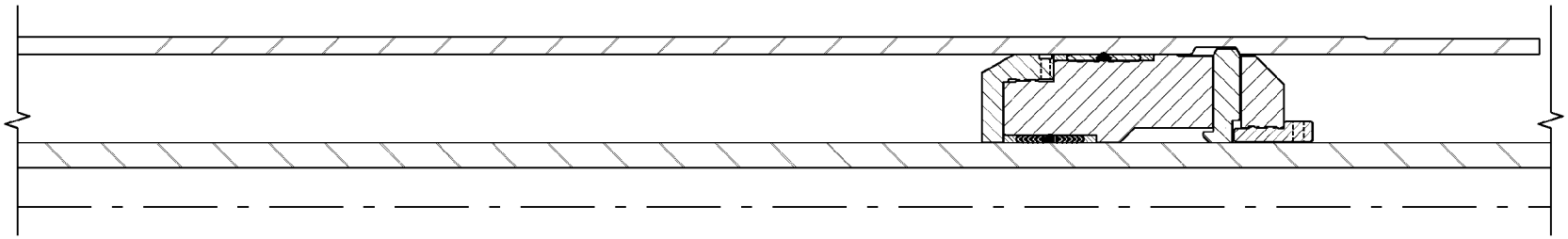
Figure 5I:
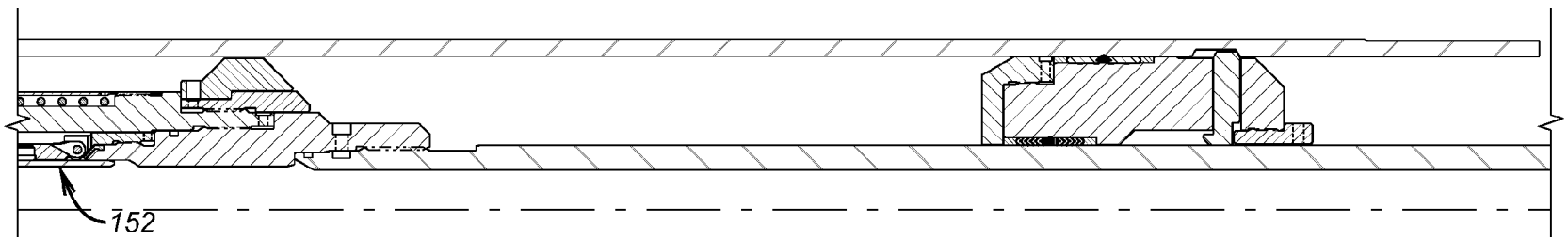
Figure 6A:
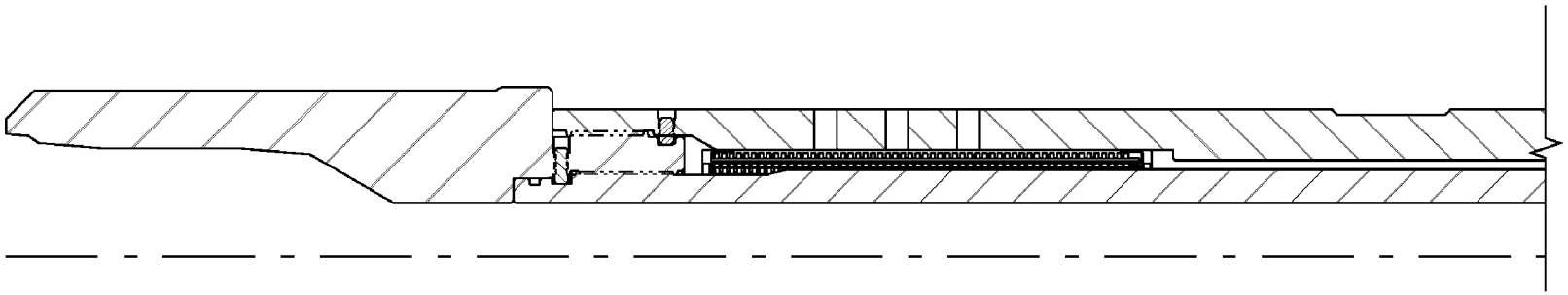
FIGS. 6*a*-6*k* shows the same tool picked up again to engage the flapper assembly in the expanded portion of the liner.
Figure 6B:
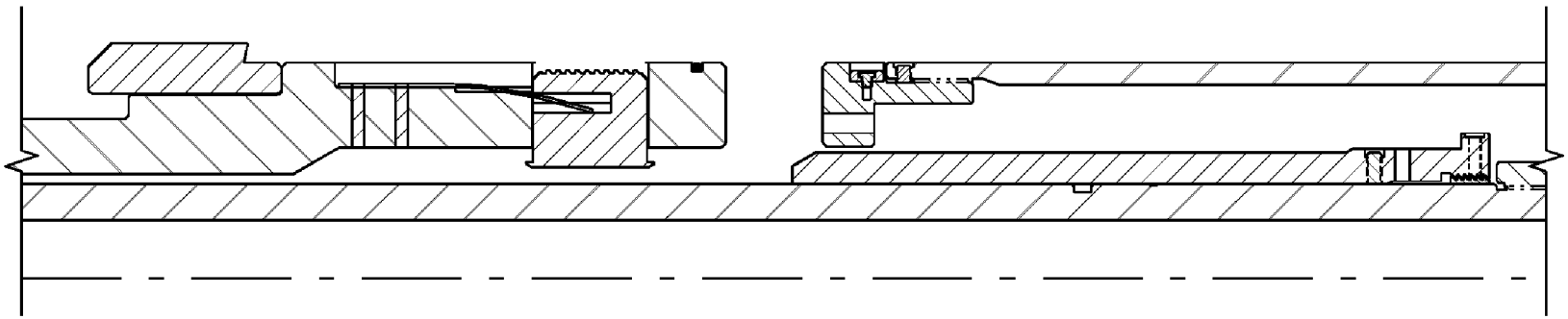
Figure 6C:
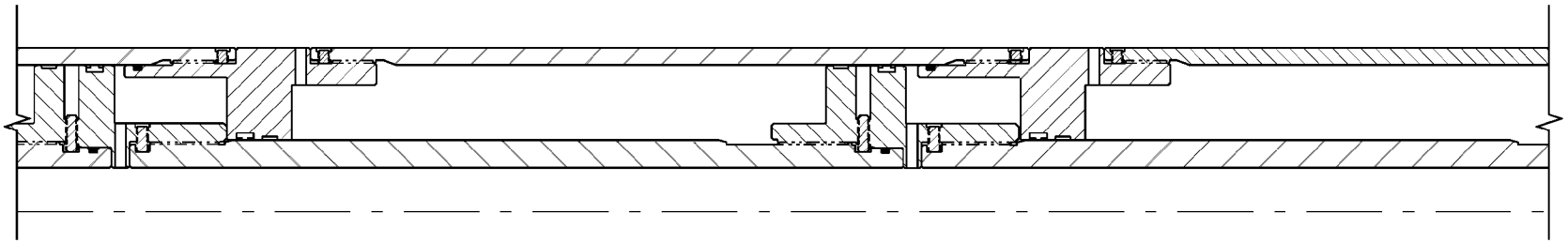
Figure 6D:
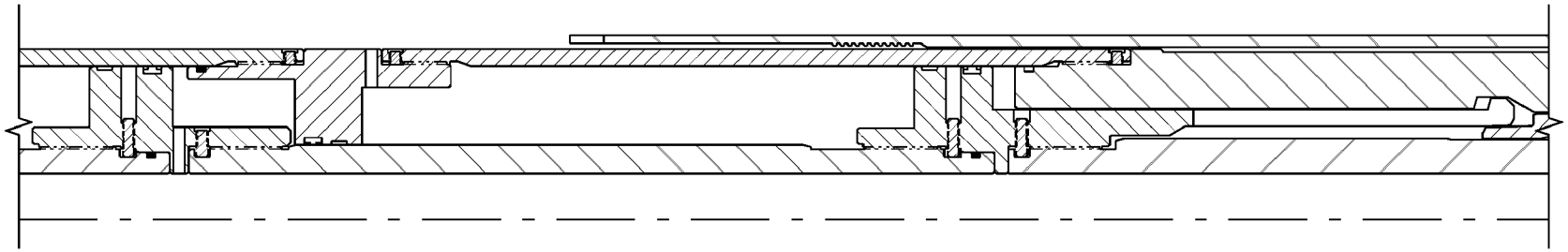
Figure 6E:
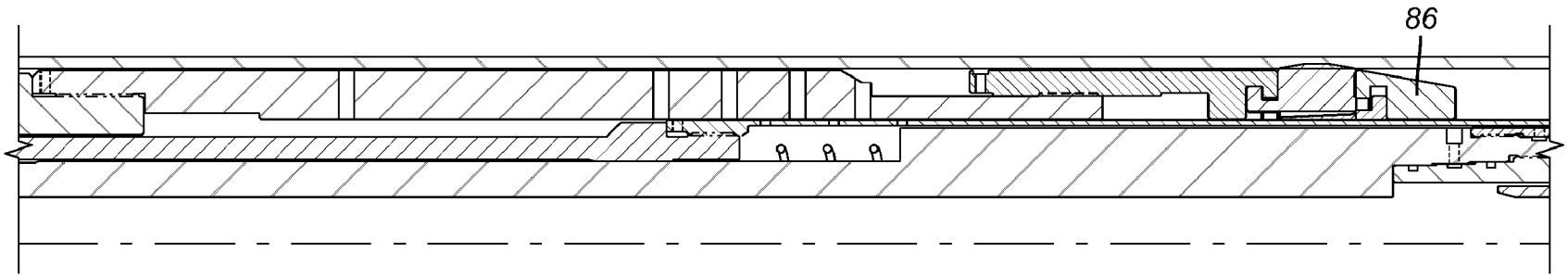
Figure 6F:
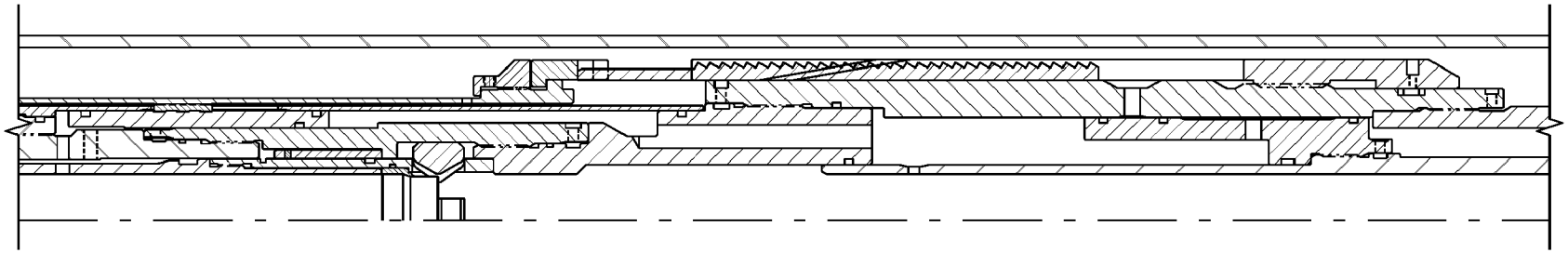
Figure 6G:
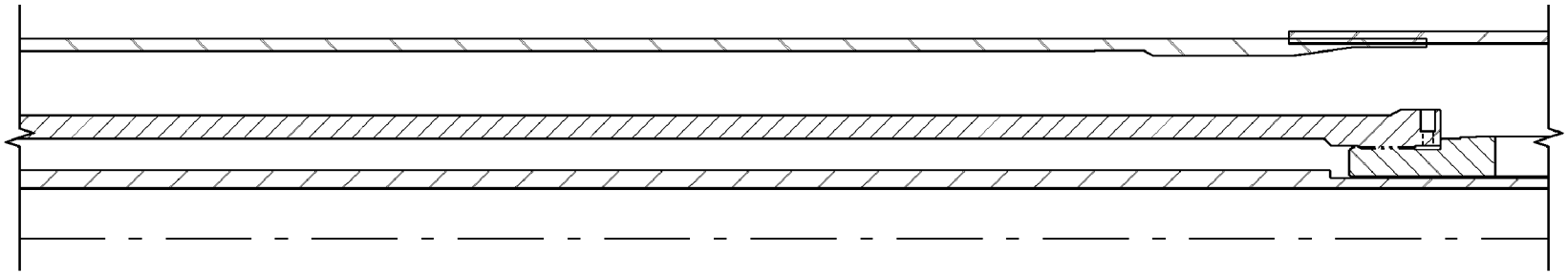
Figure 6H:
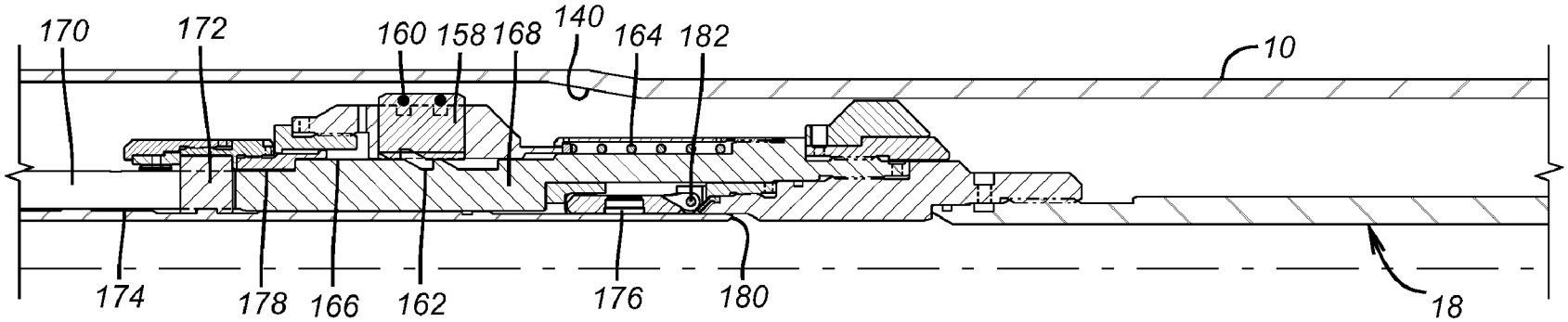
Figure 6I:
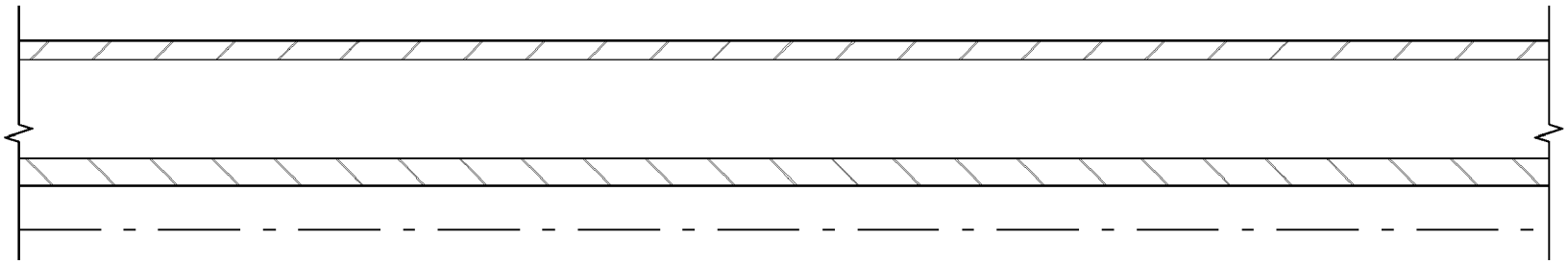
Figure 6J:
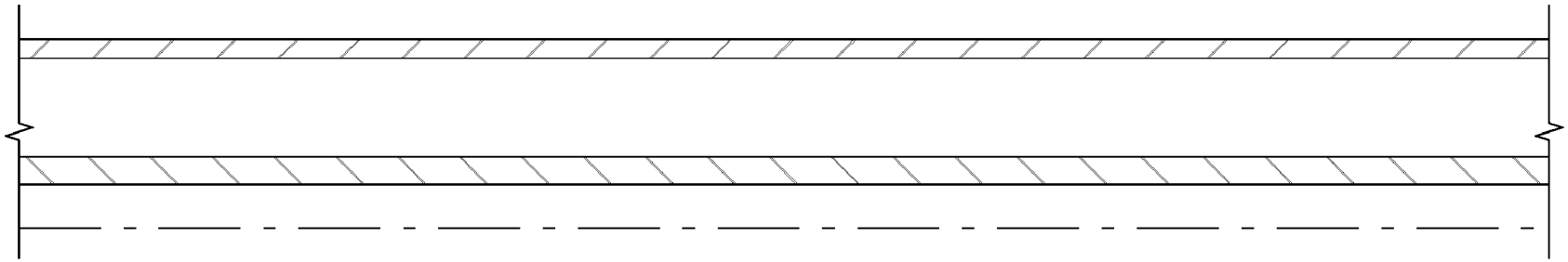
Figure 6K:
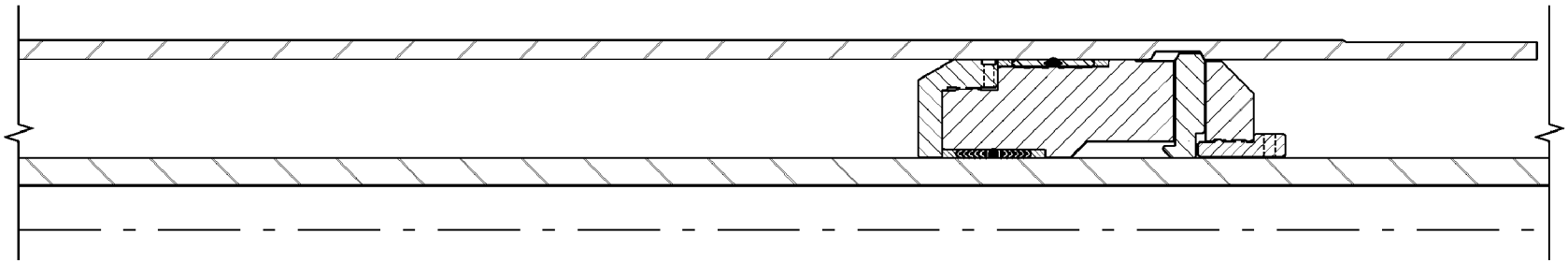
Figure 7A:
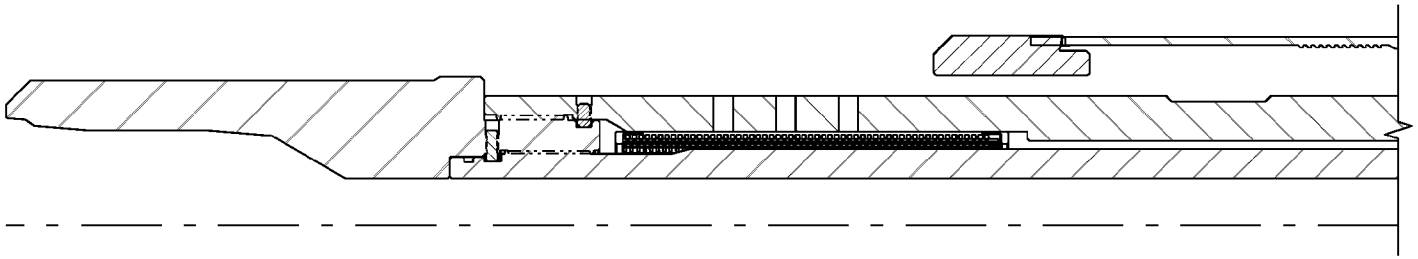
FIGS. 7*a*-7*j* show the same tool with weight set down to release the flapper.
Figure 9A:
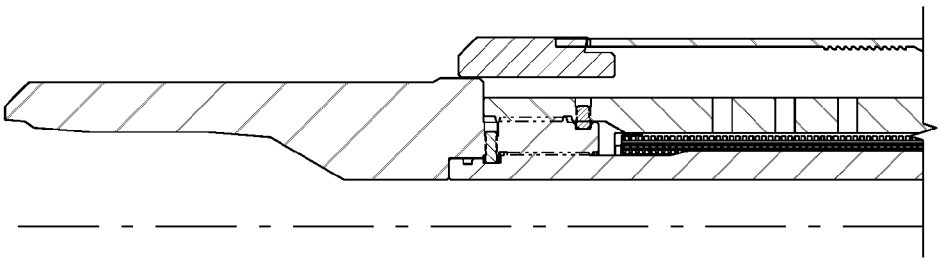
FIGS. 9*a*-9*j* show the same tool set down to release slips from the liner and relatch the pistons driving the swages.
Figure 7B:
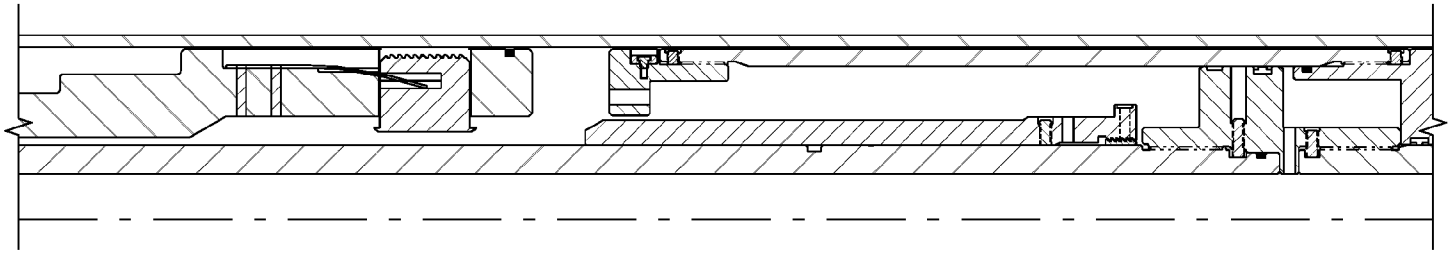
Figure 9B:
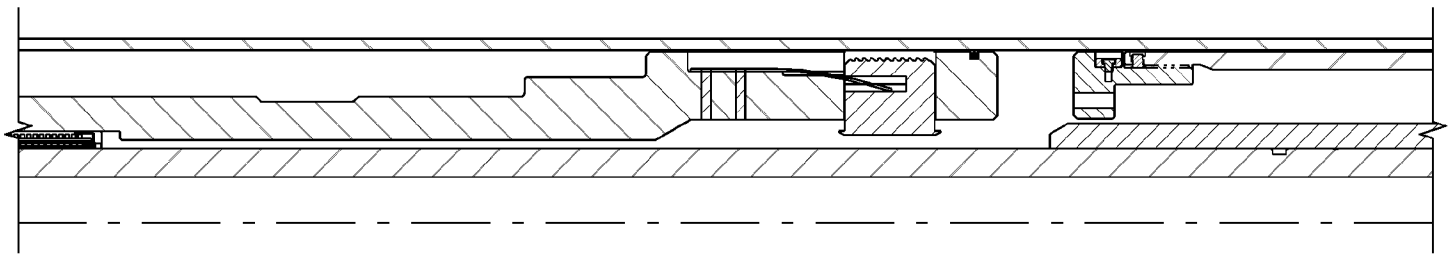
Figure 7C:
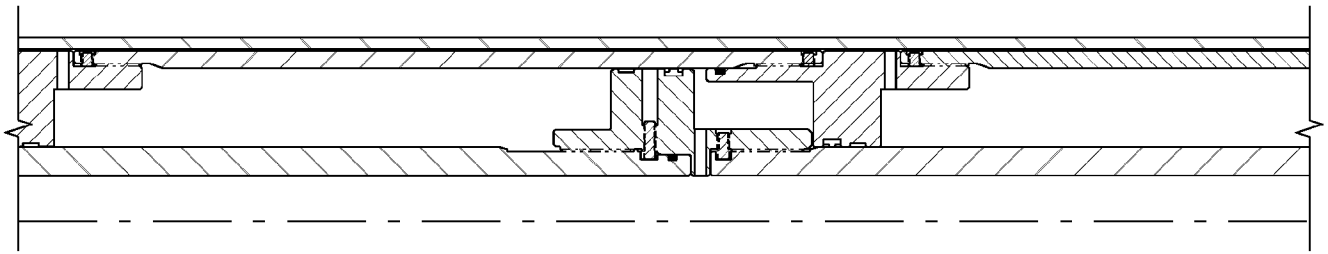
Figure 9C:
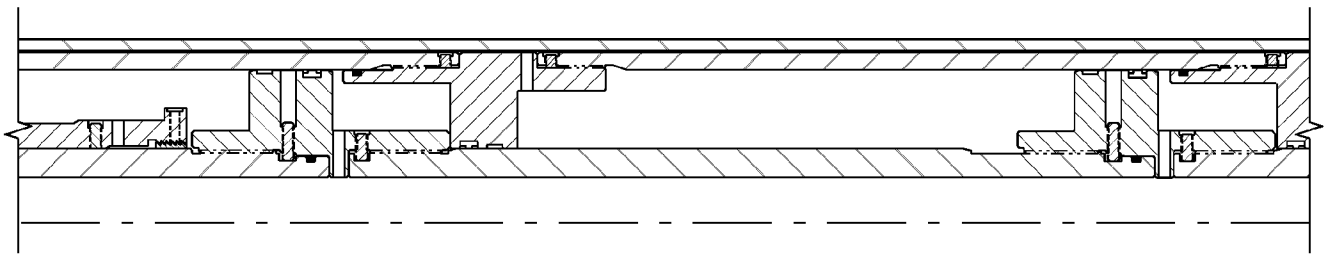
Figure 7D:
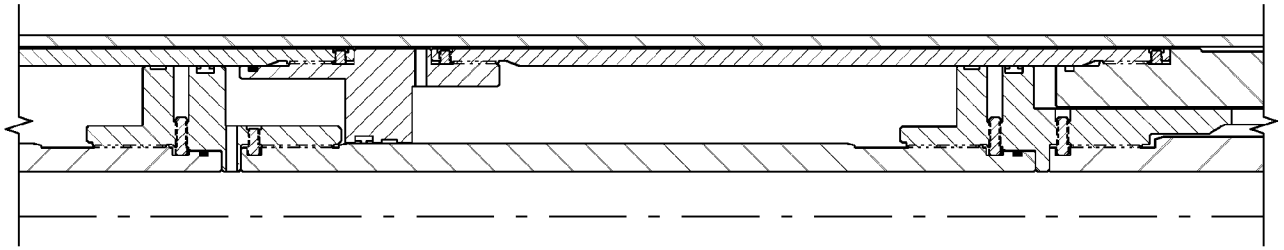
Figure 9D:
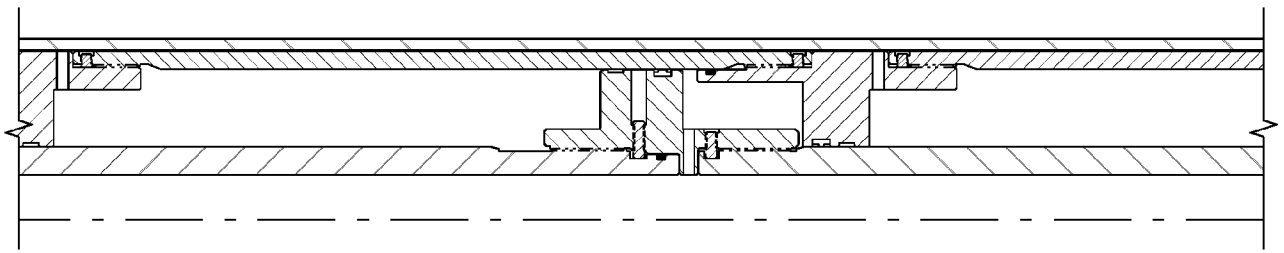
Figure 7E:
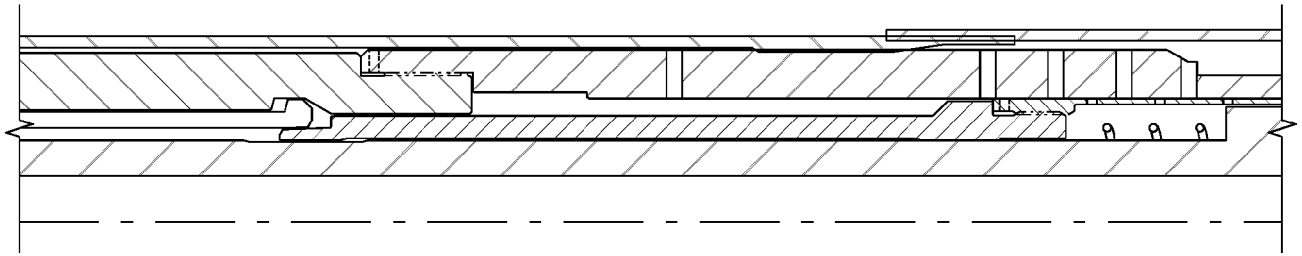
Figure 9E:
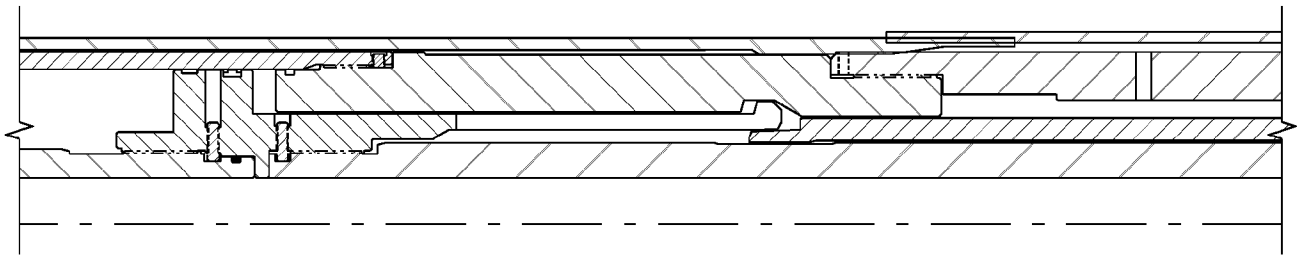
Figure 7F:
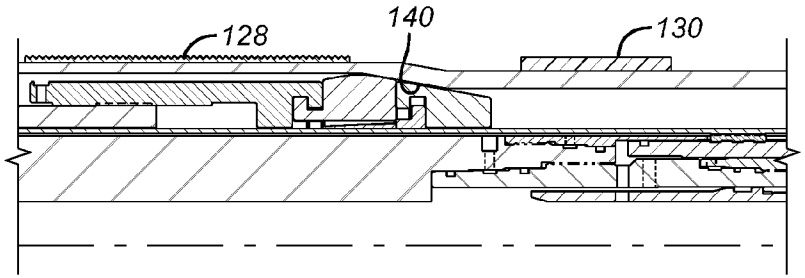

The next step will be another pickup for a distance greater than the pick up movement in FIG. 4. This pick up distance will be about fifteen feet or a distance sufficient to raise the flapper assembly 152 from its FIG. 5*h*-5*i* position to where it is above the taper 140 as shown in FIG. 6*h*. The details of the flapper assembly 152 will now be described using FIG. 1*h* which shows it in the run in position and 6*h* which shows it latched above taper 140. Referring to FIG. 1*h* a sleeve 154 has openings 156 for dogs 158 that that are radially inwardly biased by one or more band springs 160. An angled profile 162 allows spring 164 to push dogs 158 radially outwardly onto surface 166 when the flapper assembly 152 is raised above taper 140 in liner 10 as shown in FIG. 6*h*. Spring 164 pushes dogs 158 along angled profile 162 until they are pushed out far enough to land on surface 166 so that when weight is set down, the dogs will remain stationary on taper 140 inside the liner 10 as the mandrel assembly 18 is lowered. Sleeve 168 which is part of the mandrel assembly 18 moves in tandem with flapper 176 because of slot 170 with dog 172 in it permit relative motion to the stationary dogs 158 trapped in an extended position on surface 166 also stationary is sleeve 174 supported by dogs 172 which are in turn supported by dogs 158 off of taper 140 inside the liner 10. However, after a predetermined relative movement, the flapper 176 extends below the lower end 180 of sleeve 174 and a torsion spring snaps the flapper 176 onto a seat such that passage 70 is closed at flapper 176. At the same time after the flapper has snapped into passage 176, dogs 158 fall off surface 166 into recessed surface 178 which lets the dogs 158 collapse inwardly with the assist of band springs 160 back along angled profile 162. This allows dogs 158 to clear past taper 140 inside of liner 10 so that the mandrel assembly 18 can continue its downhole advance as shown in FIG. 7 until once again the swage 86 lands on the taper 140 inside the liner 10. At this point, further stroking of pistons 46, 48 and 50 will expand the seal 130 into the surrounding tubular (not shown) as will be explained below.

Figure 8A:
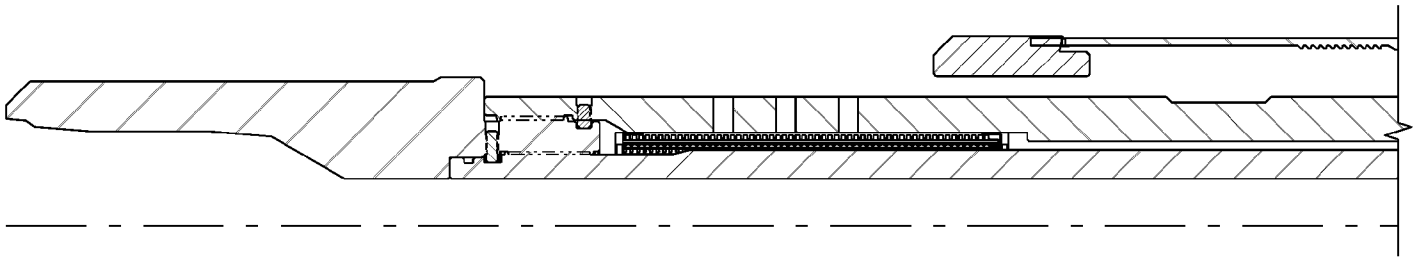
FIGS. 8*a*-8*j* show the same tool with further expansion to seal the liner.
Figure 8B:
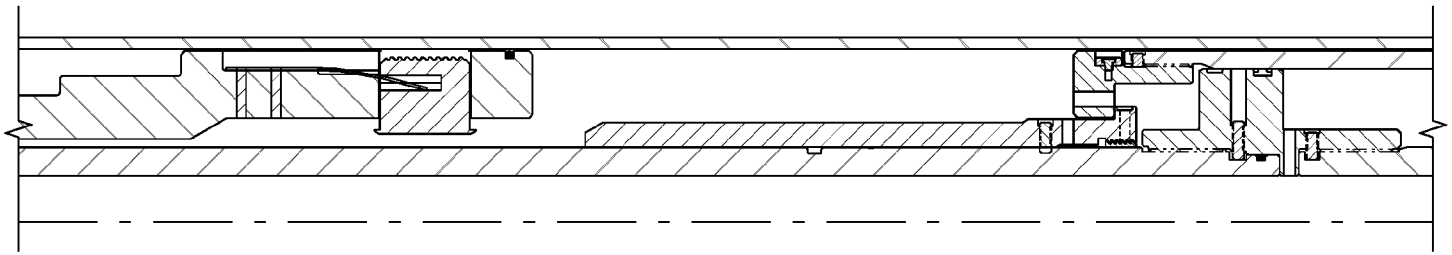
Figure 8C:
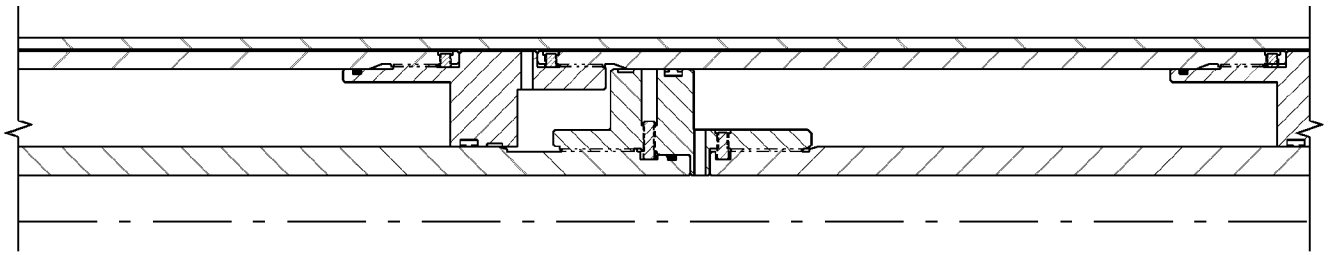
Figure 8D:
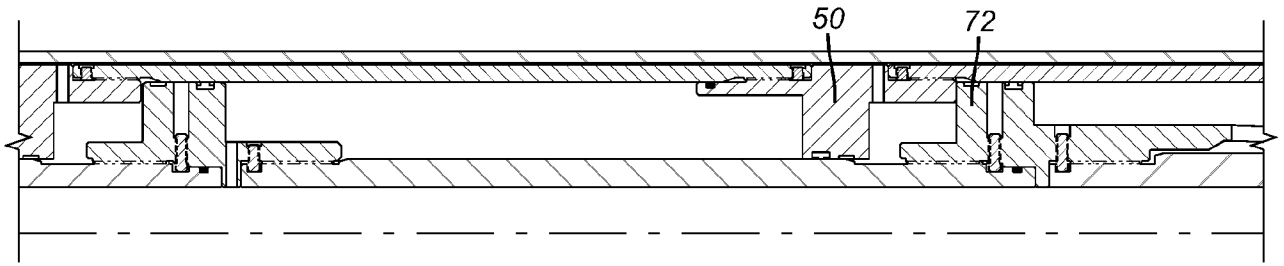
Figure 8E:
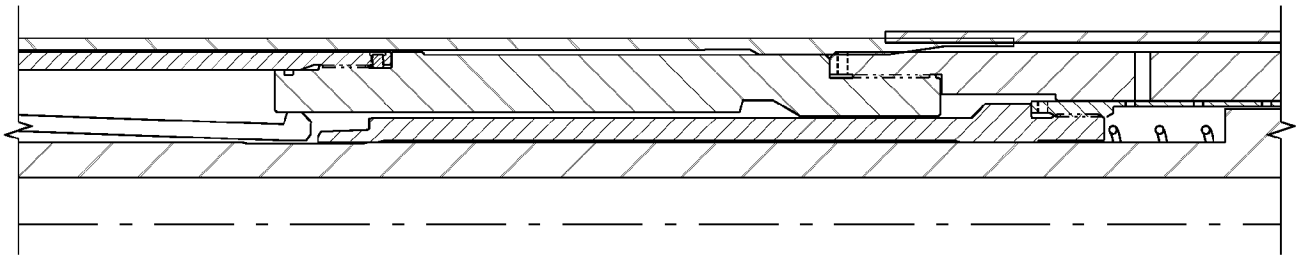
Figure 8F:
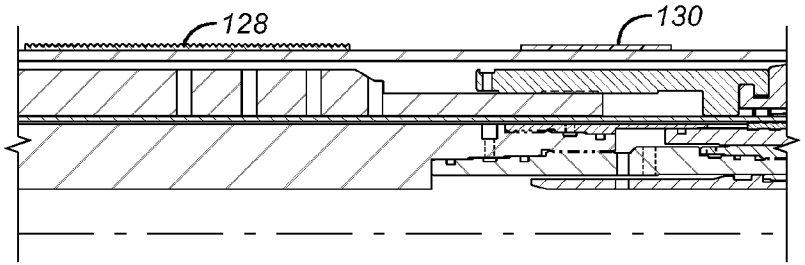
Figure 9F:
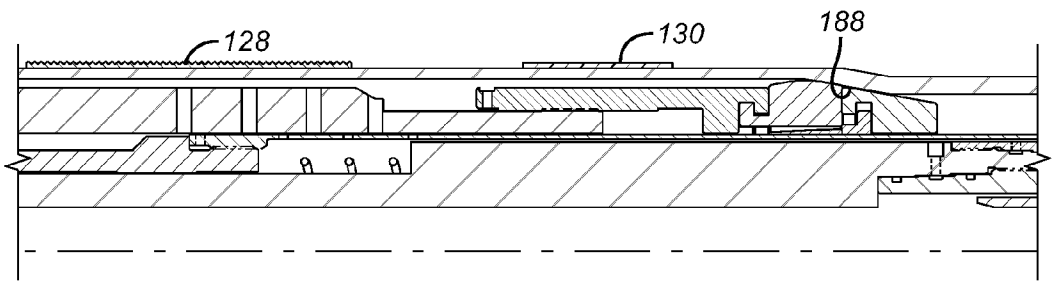
Figure 7G:
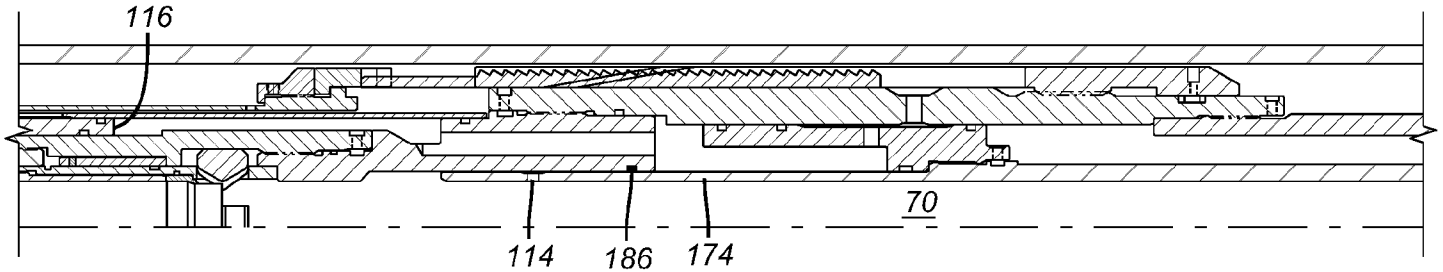
Figure 8G:
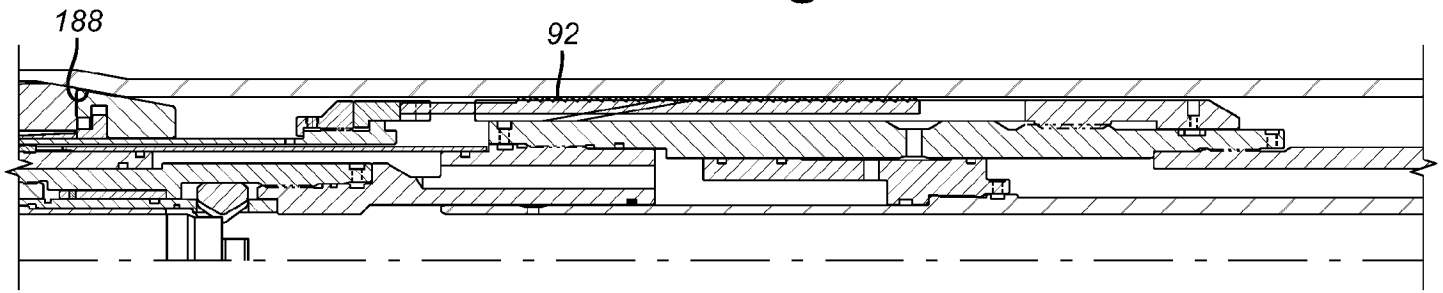
Figure 9G:
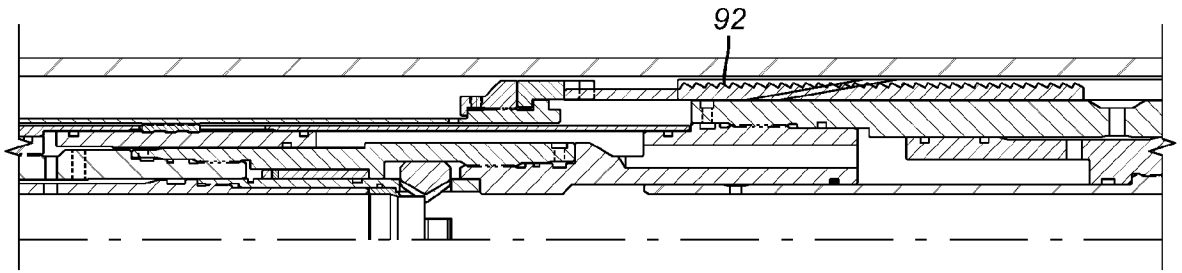
Figure 7H:
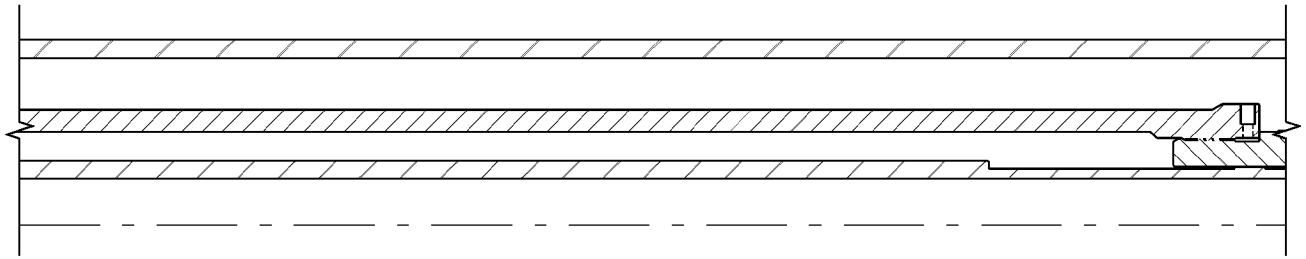
Figure 8H:
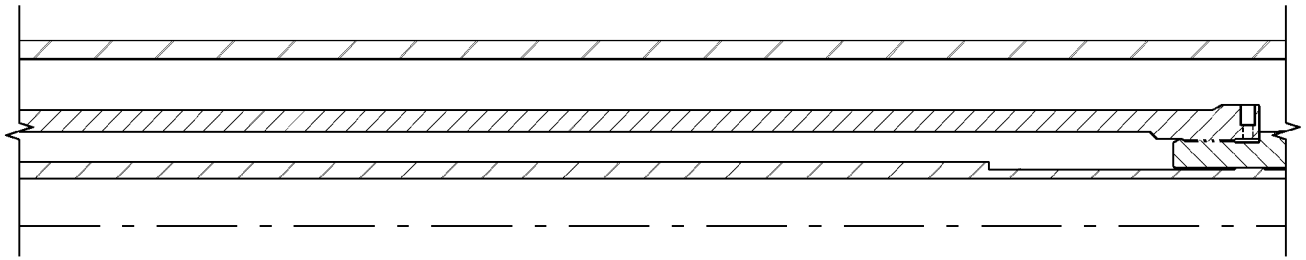
Figure 9H:
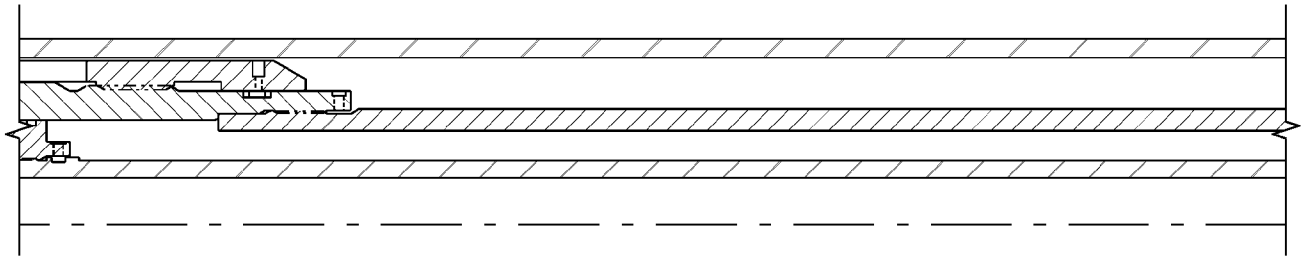
Figure 7I:
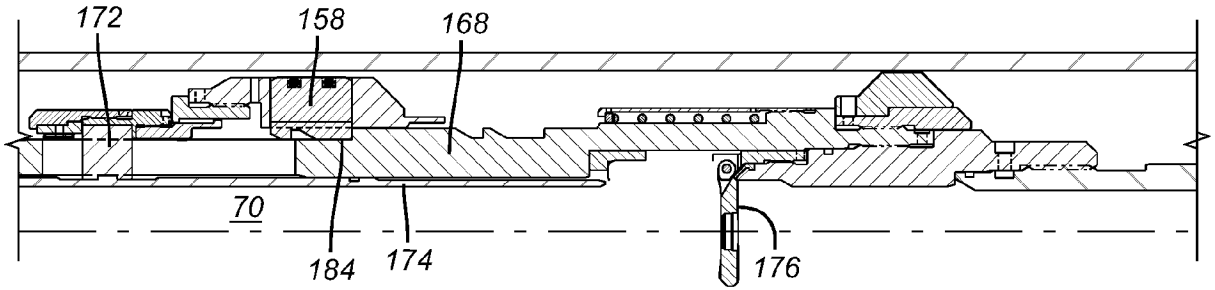
Figure 8I:
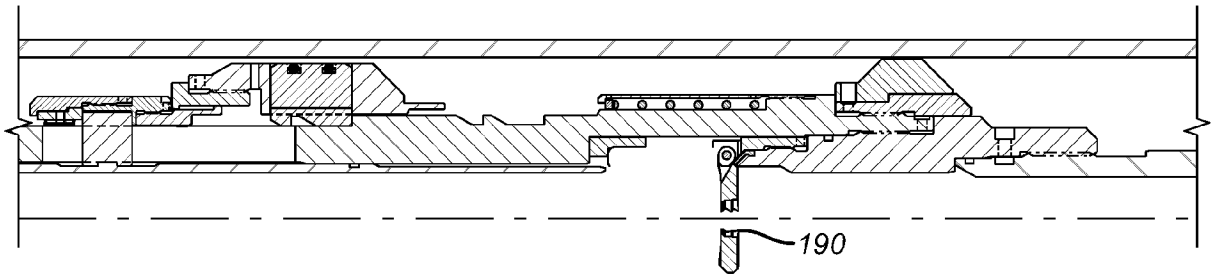
Figure 7J:
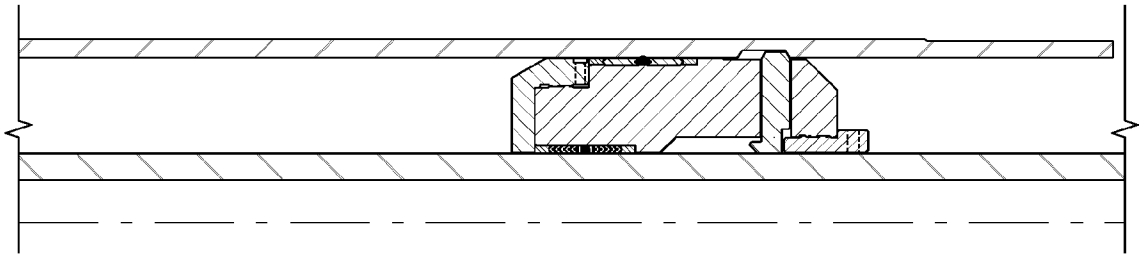
Figure 8J:
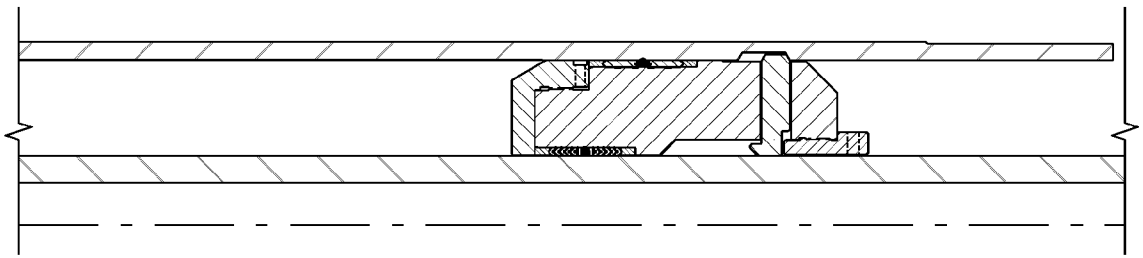

Referring to FIG. 7*i* it should be noticed that dogs 158 now rest on surface 184 of sleeve 168. Recalling that the position of dogs 172 relative to dogs 158 is fixed and that sleeve 174 rides with dogs 158 it can be seen that lower end 180 of sleeve 174 has moved up with respect to mandrel assembly 18 and more specifically sleeve 168. This relative movement also results in ports 114 open in FIG. 1*f* to now go closed as shown in FIG. 7*g*. Sleeve 174 now covers seal 186 cutting off communication from passage 70 to the bottom of piston 98 at its bottom surface 116. With flapper 176 closing passage 70 and pressure built up on the seated flapper 176 the FIG. 2 sequence described above repeats because piston 98 is subjected to an unbalanced force from passage 70. Referring to FIG. 8*f*-8*g* it can be seen that taper 140 no longer exists and is replaced by taper 188 further down liner 10 and that the seal assembly 130 is now securely pressed against the surrounding tubular (not shown) putting the current status of liner 10 as released from the mandrel assembly 18, fully cemented, mechanically supported at 128 and sealed to the surrounding tubular (not shown) at 130. With slips 92 attached to the inside of the liner in FIG. 8*g* and piston 50 against travel stop 72, any further pressure buildup against the closed flapper 176 will blow out the flapper mounted rupture disc 190 shown in FIG. 8*i*.

Figure 10A:
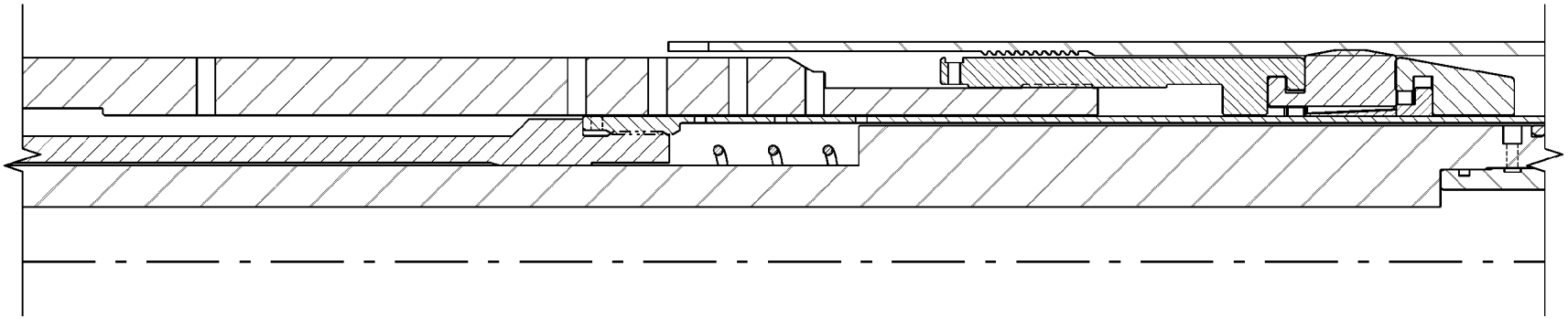
FIGS. 10*a*-10*b* show parts of the same tool as it is removed from the liner.

With the rupture disc 190 broken weight is set down to release slips 92 just as they were earlier released in FIG. 3 and the tool configuration returns to the run in position of FIG. 1 with the difference being that the lead swage 86 has expanded the liner 10 down to taper 188 which now supports the mandrel assembly 18. The mandrel assembly is ready to be pulled out. FIG. 10*a* shows the lead swage 86 coming up past the top of liner extension 14 with the rest of the tool previously described disposed even higher.

Figure 9I:
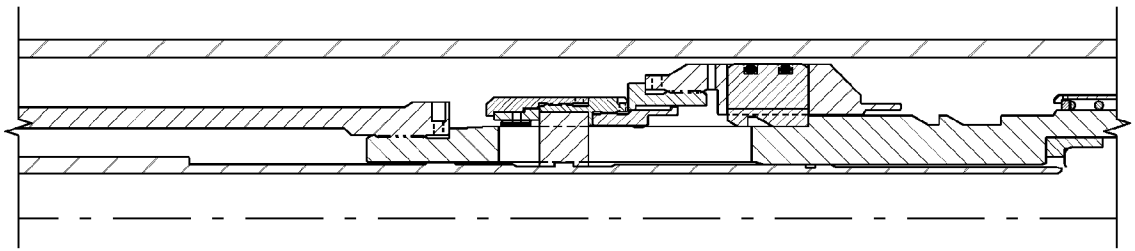
Figure 9J:
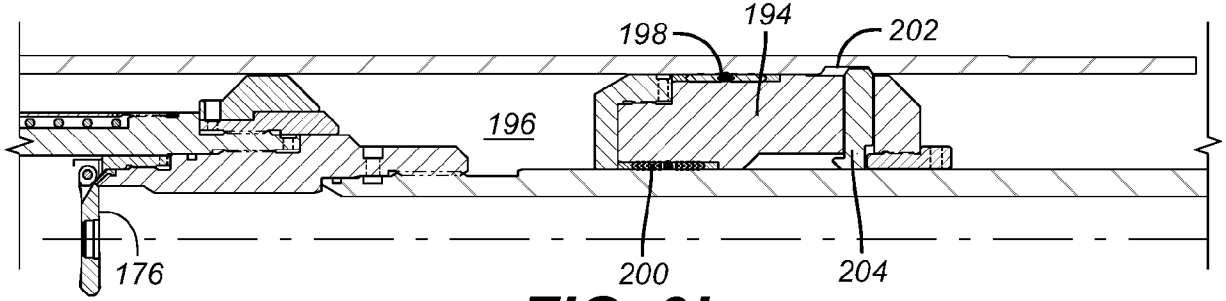
Figure 10B:
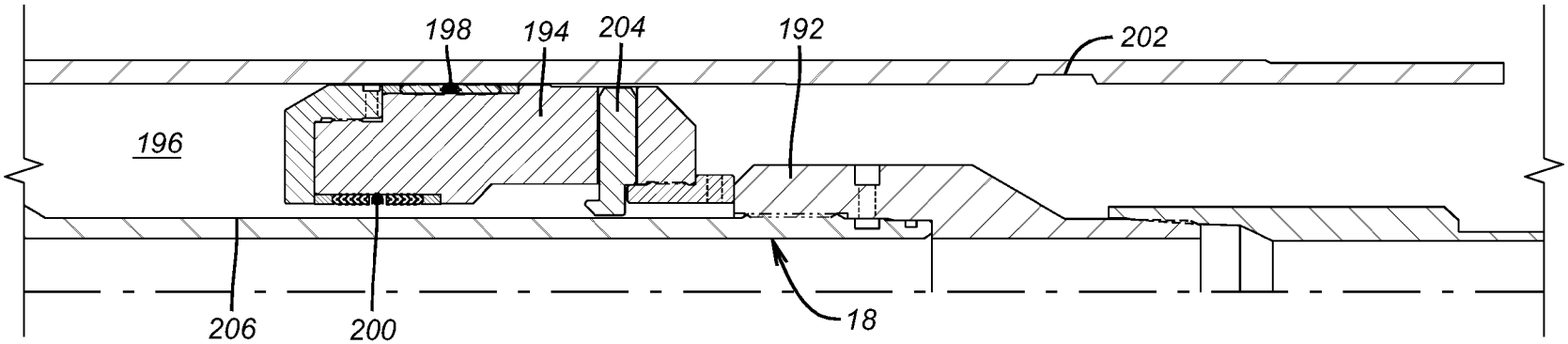

In another glimpse further down from FIG. 10*a*, FIG. 10*b* shows the collar 192 on mandrel assembly 18 engaging annular packoff 194 so that it can be removed with the mandrel assembly 18. Comparing FIG. 9*j* with 10*b* it can be seen that throughout the movements described up to now, the packoff 194 has allowed relative movement between the mandrel assembly 18 and the liner 10 while sealing off the annular space 196 using seals 198 and 200. The purpose of this large seal is to prevent cement that exits the mandrel assembly 18 and goes into the liner 10 above the bit (not shown) from going further up in the annular space between the mandrel assembly 18 and the liner 10.

It is also notable from FIG. 9*j* that the packoff 194 is secured to groove 202 on the inside of the liner 10 by a dog 204 that is supported from the mandrel assembly 18. This locked arrangement with the liner 10 supported to the surrounding tubular (not shown) resists push out forces from flow through the end of the mandrel assembly and into the interior of the liner 10 down to the cementing shoe and bit (not shown). The remaining push out force from fluid flow through the mandrel assembly 18 then is only its diameter inside of seal 200 since the mandrel assembly 18 remains movable with respect to packoff 194. For larger size applications the packoff 194 is placed below the swages 86 and 84 and anchoring slips 92 as opposed to above them as will be shown in an alternative embodiment. The location of such a seal as packoff 194 is determined by the piston area for a push out force that will be presented to the surface equipment. The string weight and load on the string from the surface should exceed the push out force which in turn is dependent on the piston area of such a seal. For the smaller sizes such as under 8 inches the piston area happens to be manageable from putting the annulus barrier between the mandrel and surrounding liner above the swage and anchor slip assembly to make swaging possible. For the larger sizes it has been determined that a lower location for the packoff 194 is advantageous couple with anchoring it to the liner 10 to reduce the effective piston area for the push out force.

Referring again to FIG. 10*b* it can be seen that when the mandrel assembly 18 is pulled out of the liner 10 that a groove 206 aligns with dogs 204 to let them come out of groove 202 so that the packoff 194 can come out with the mandrel assembly 18.

Figure 11A:
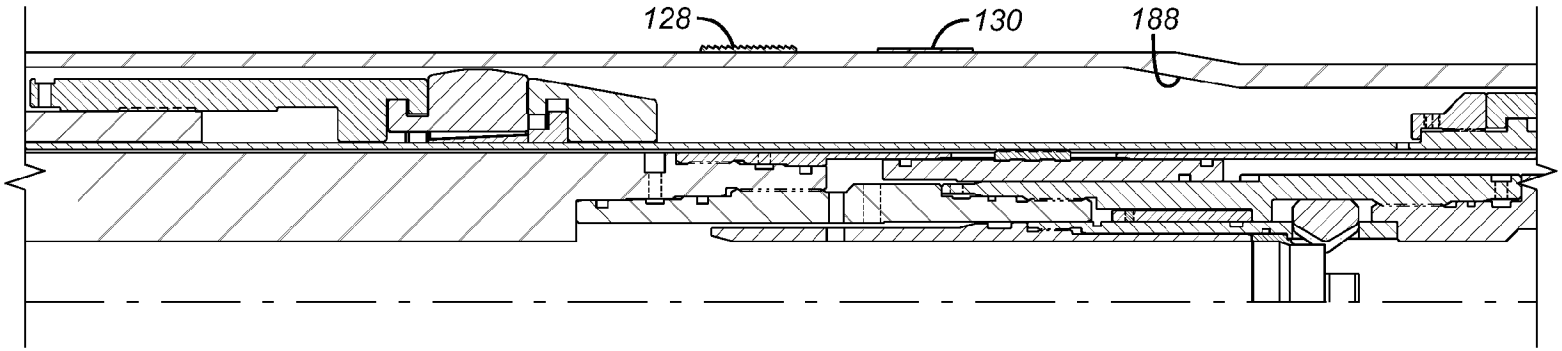
FIGS. 11*a*-11*b* show a part of the same tool where the emergency release is actuated.
Figure 11B:
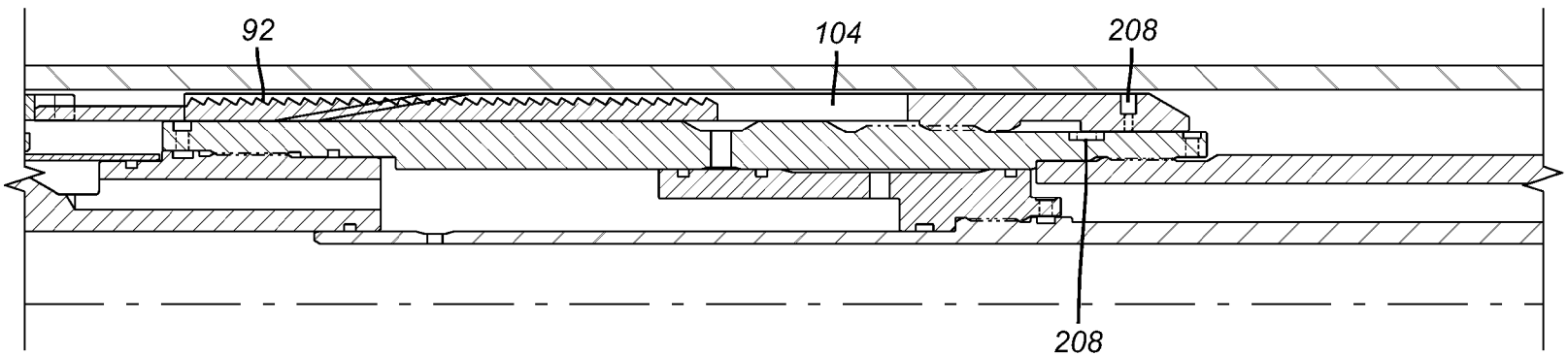

FIGS. 11*a*-11*b* illustrate the use of the emergency release mentioned before. If slips 92 fail to release after expansion is complete to taper 188 and in response to a set down of weight as described in conjunction with FIG. 9, then the mandrel assembly is rotated to the right and shear pin 208 breaks as the cone 104 is forced down and out from under slips 92. The mandrel assembly 18 can now be removed.

Figure 12A:
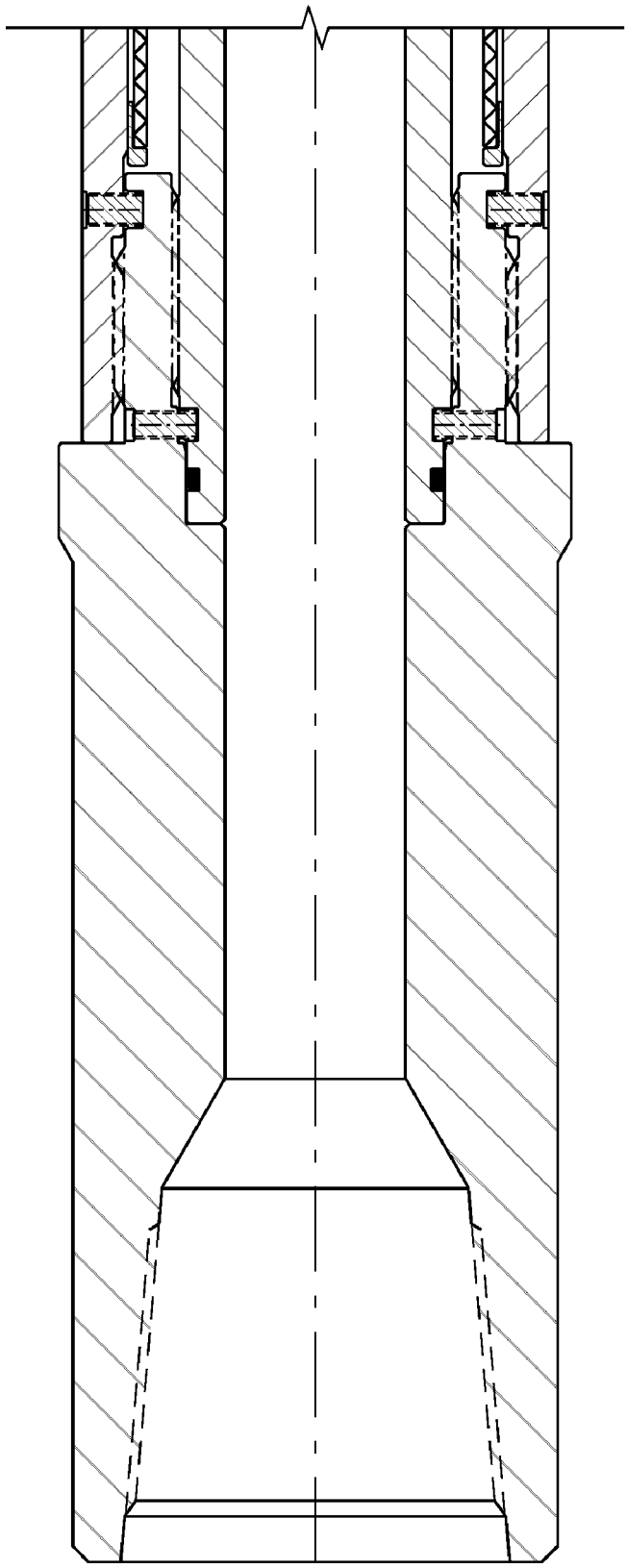
FIGS. 12*a*-12*p* show another embodiment of the tool in the run in position.
Figure 12B:
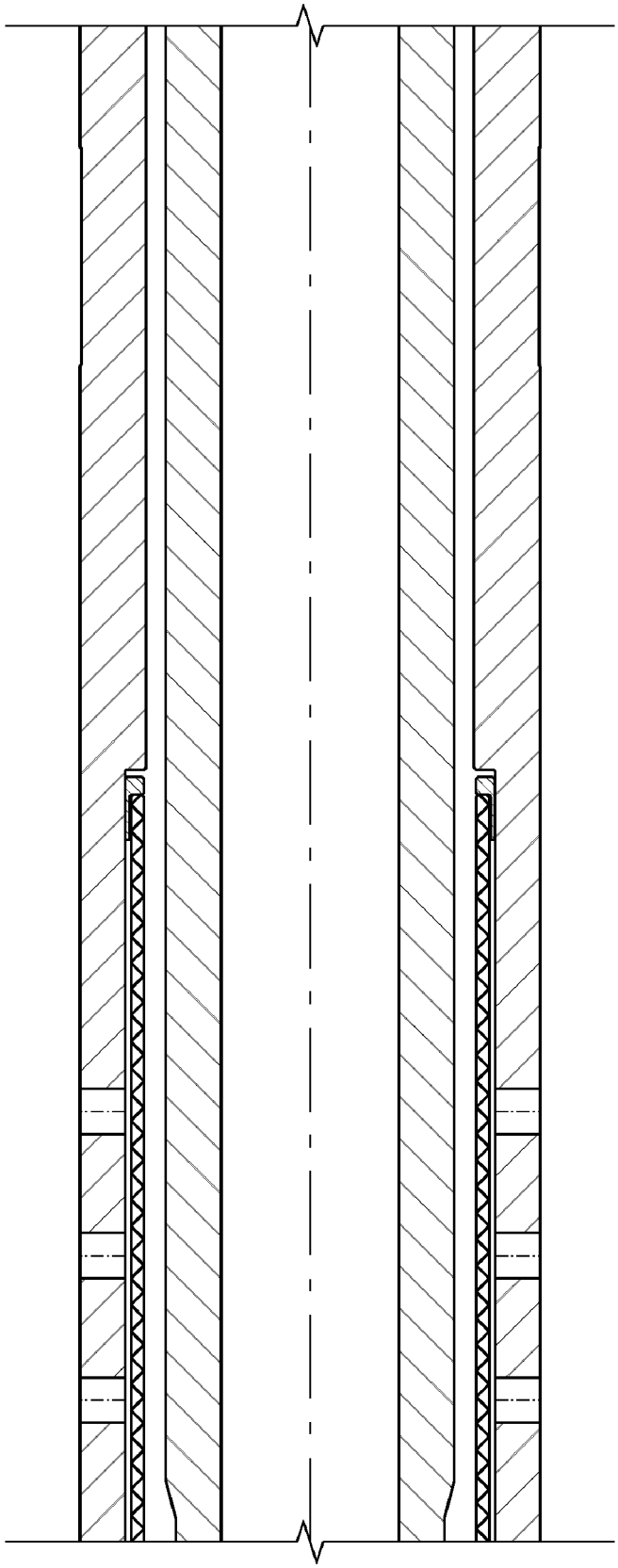
Figure 12C:
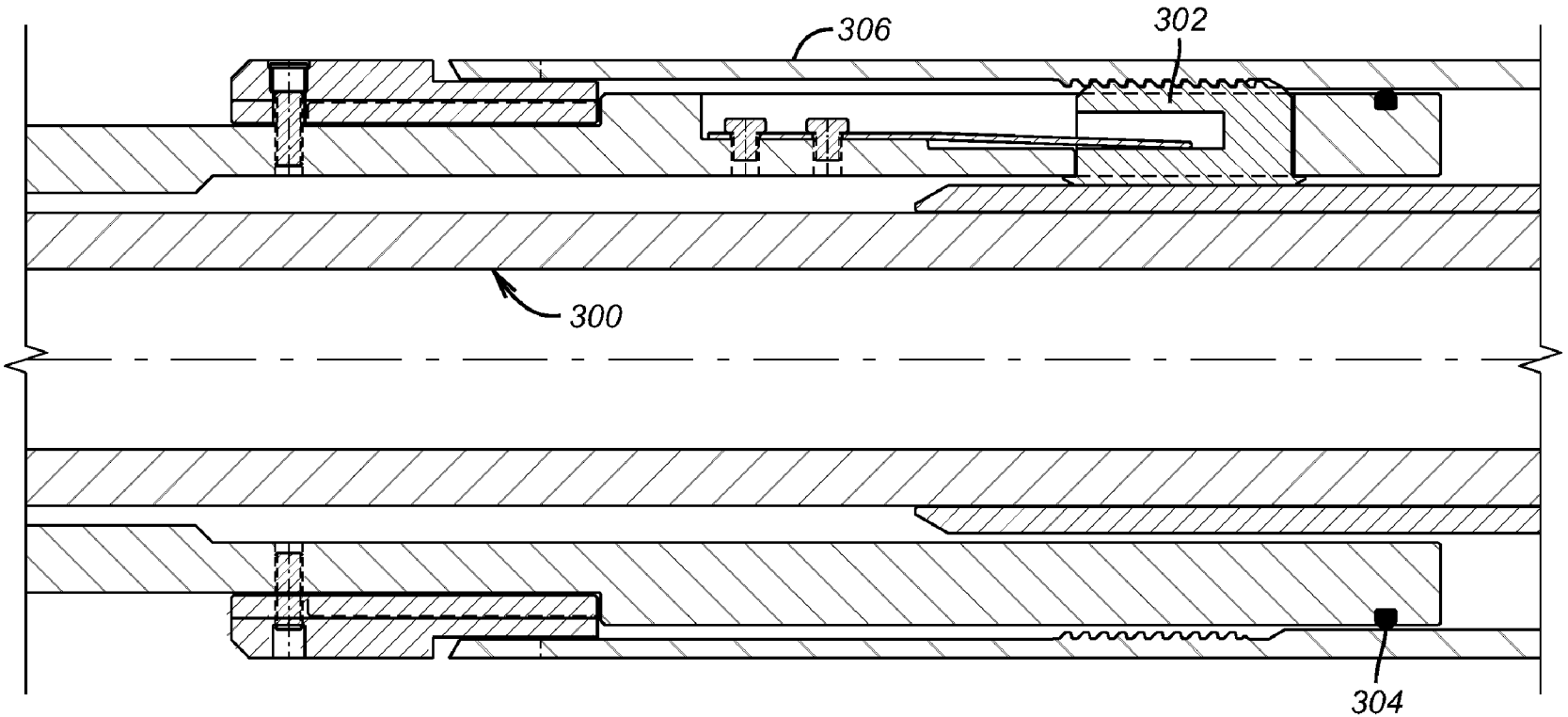
Figure 12D:
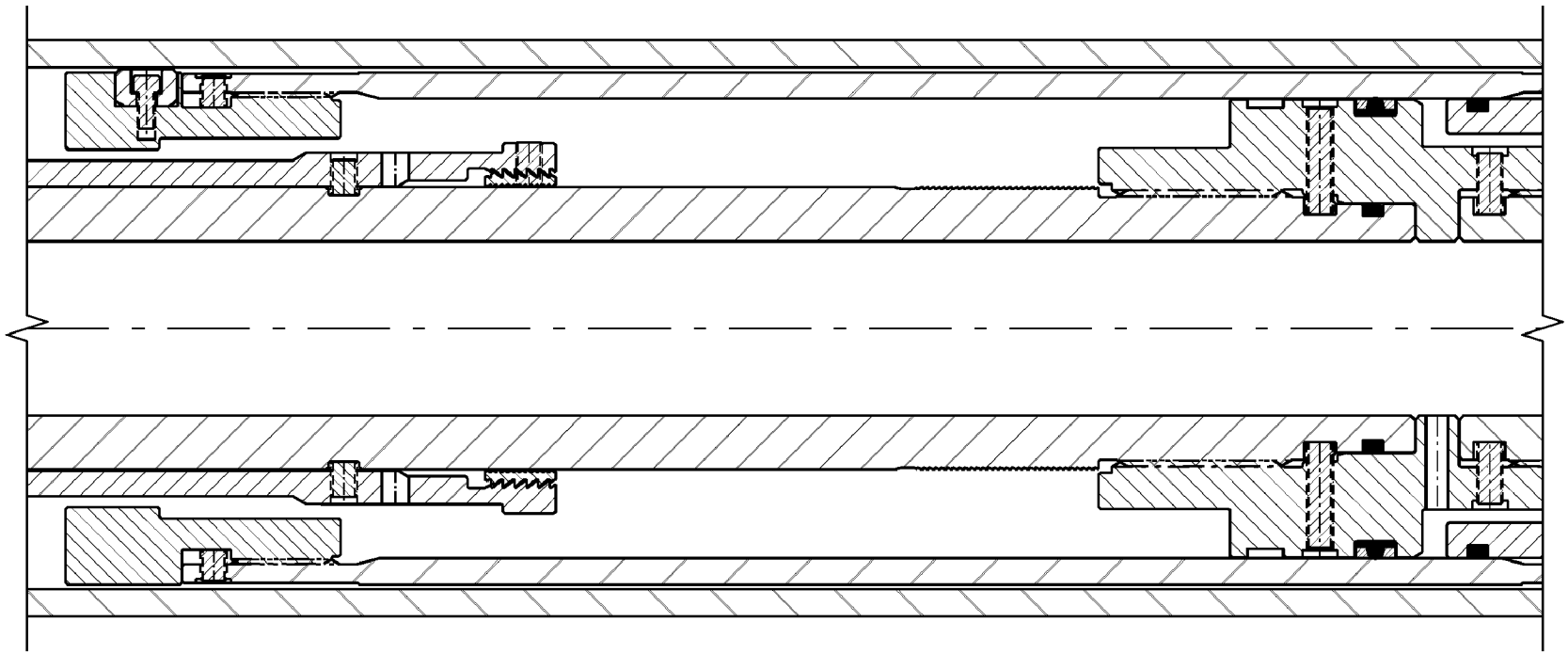
Figure 12E:
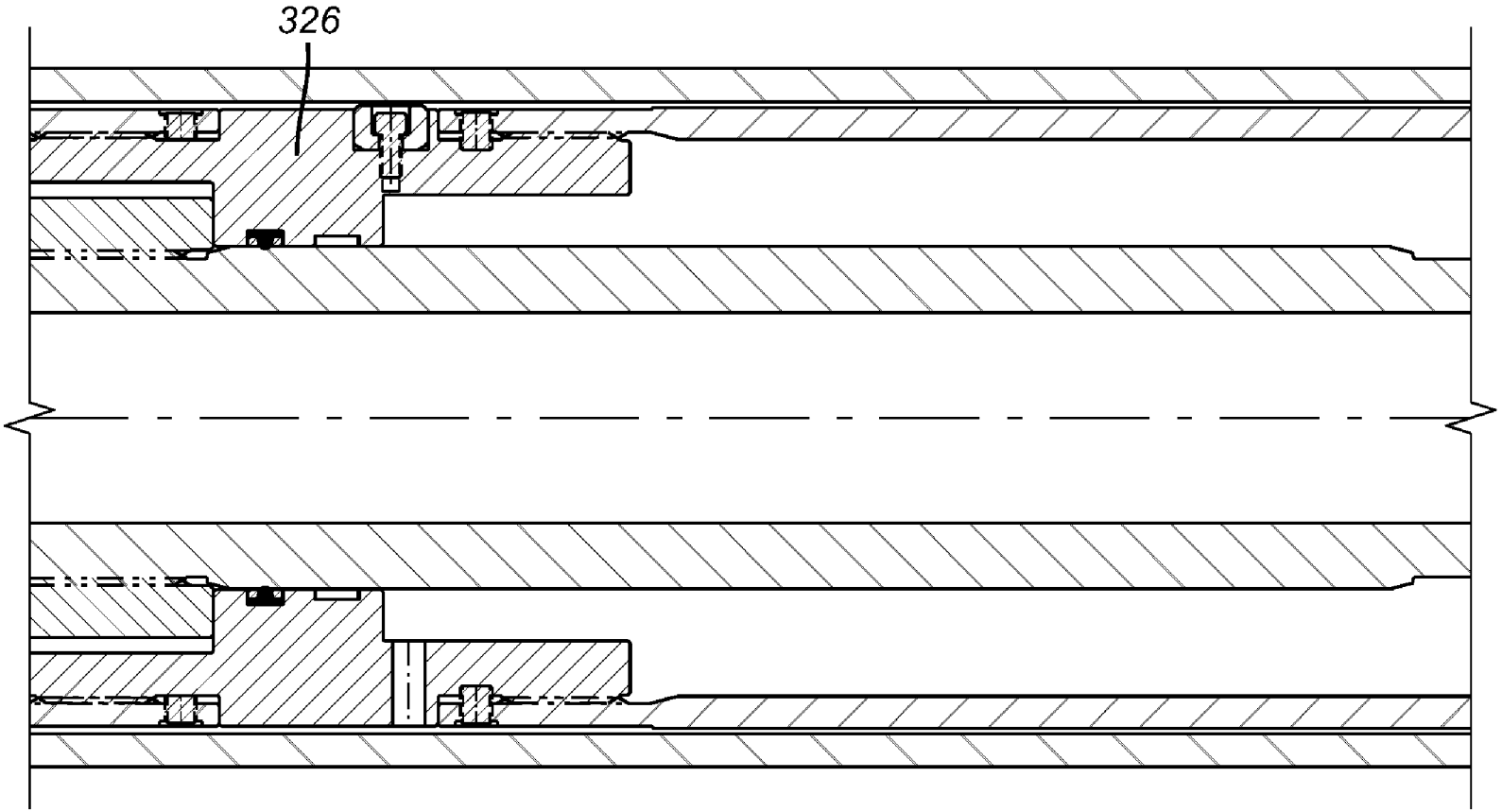
Figure 12F:
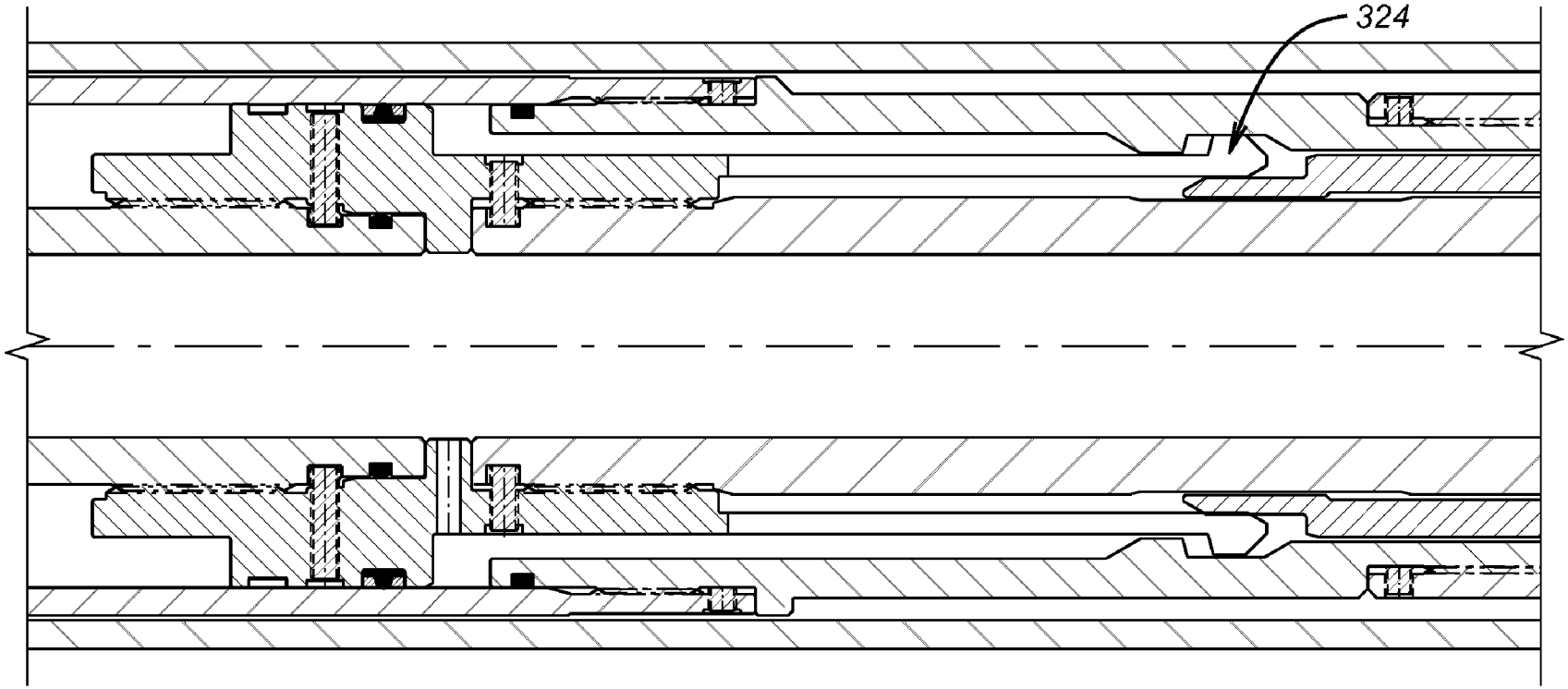
Figure 12G:
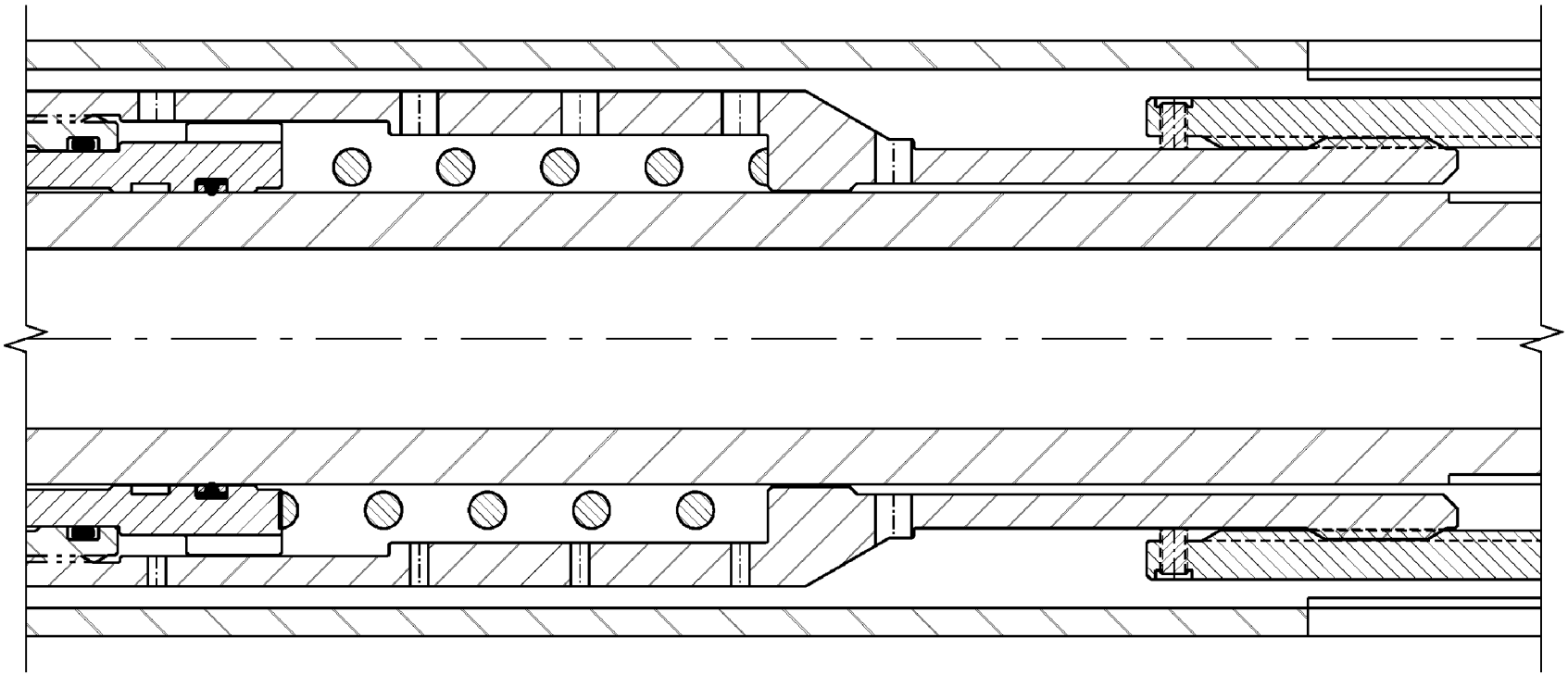
Figure 12H:
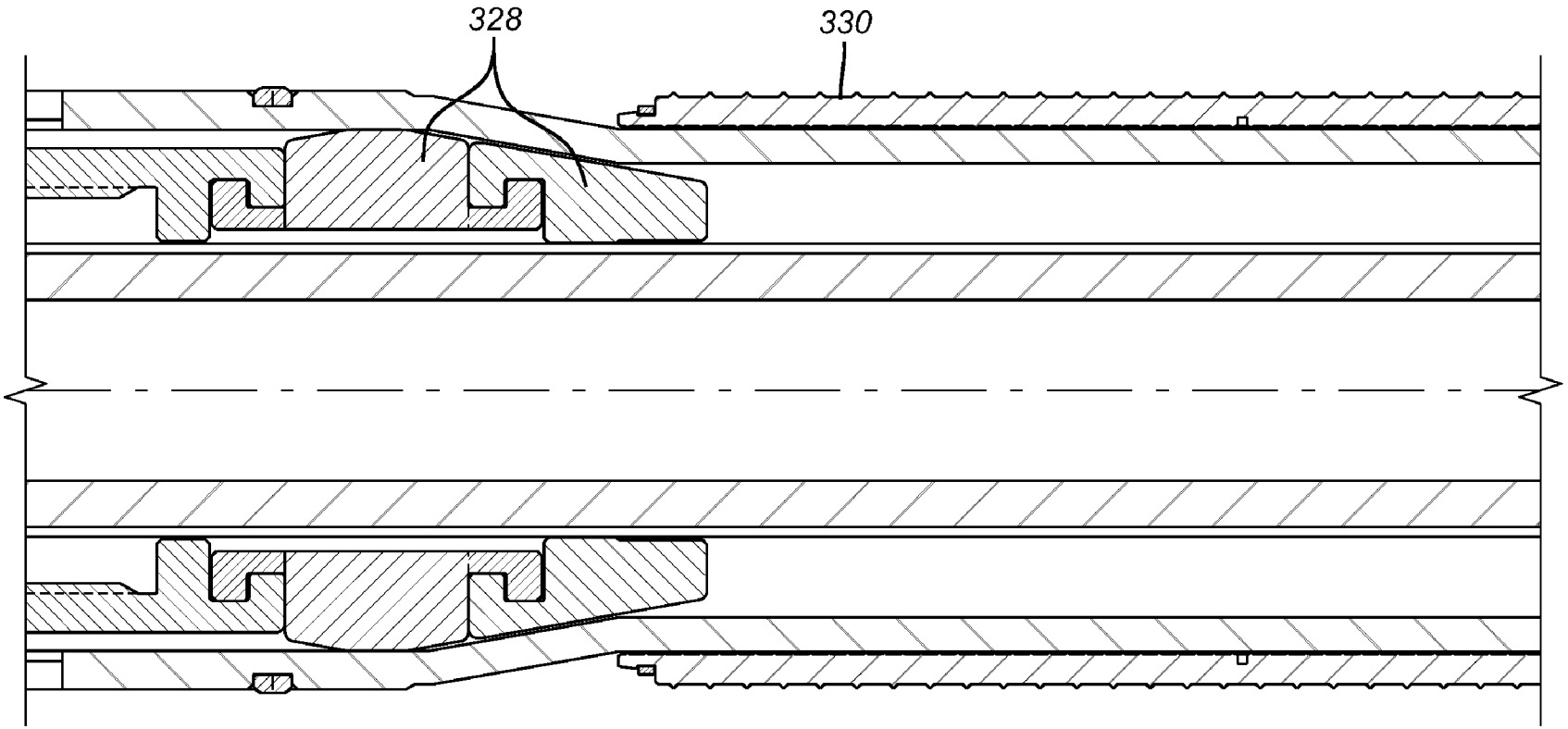
Figure 12I:
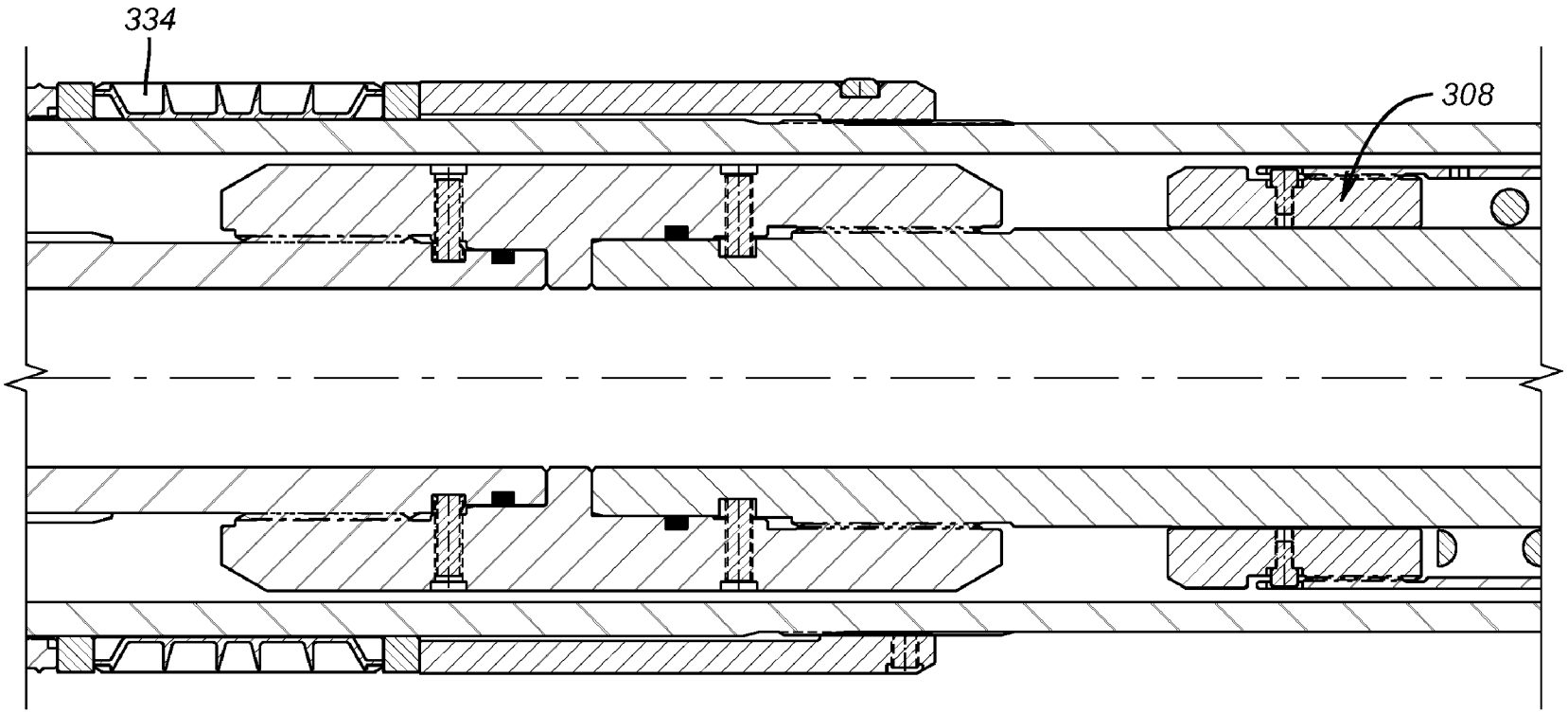
Figure 12J:
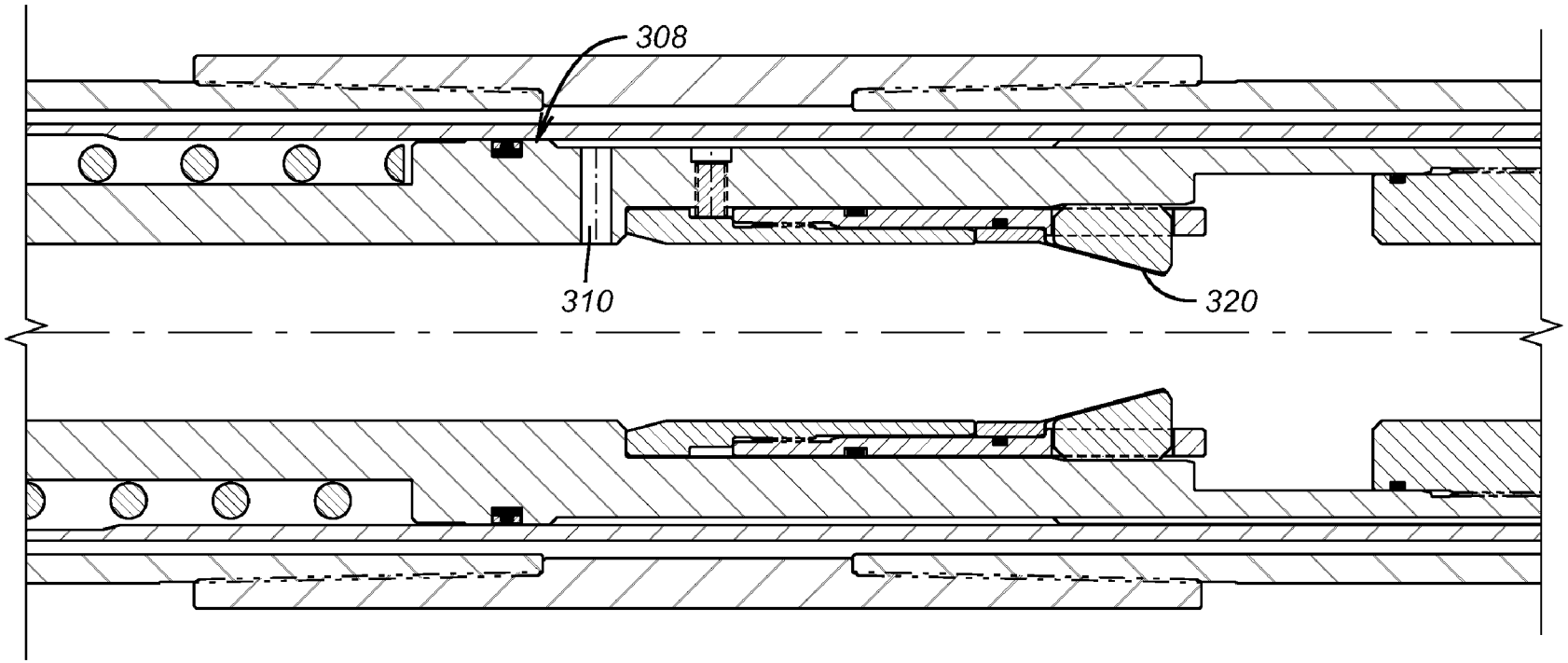
Figure 12K:
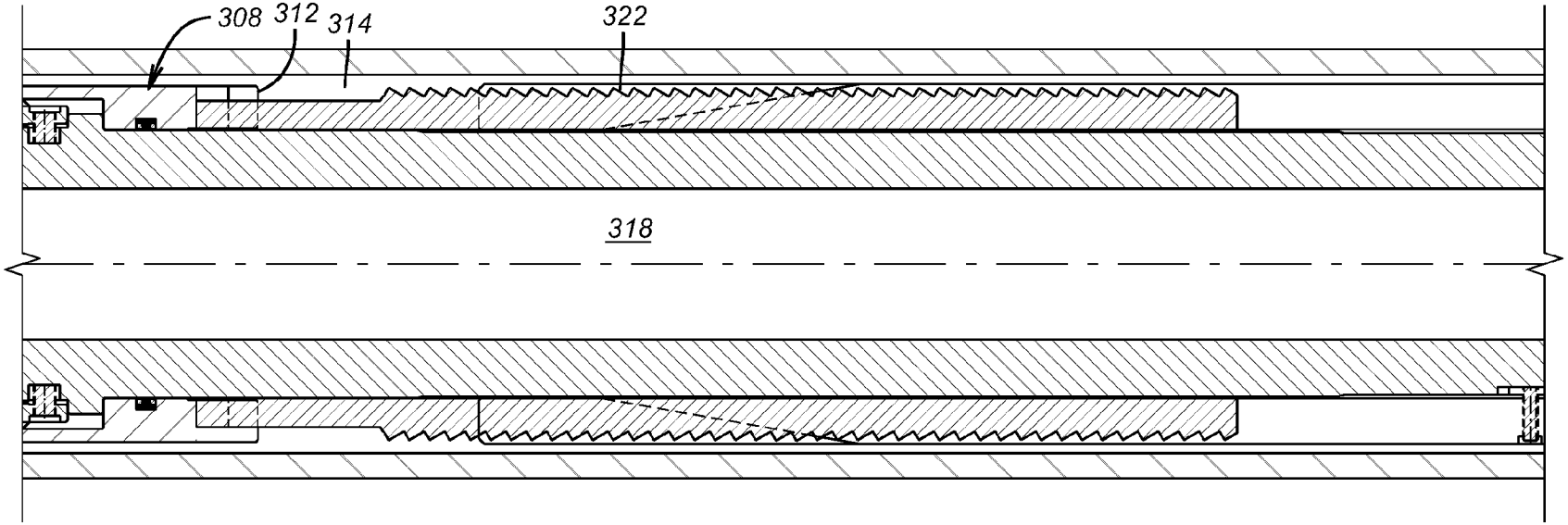
Figure 12I:
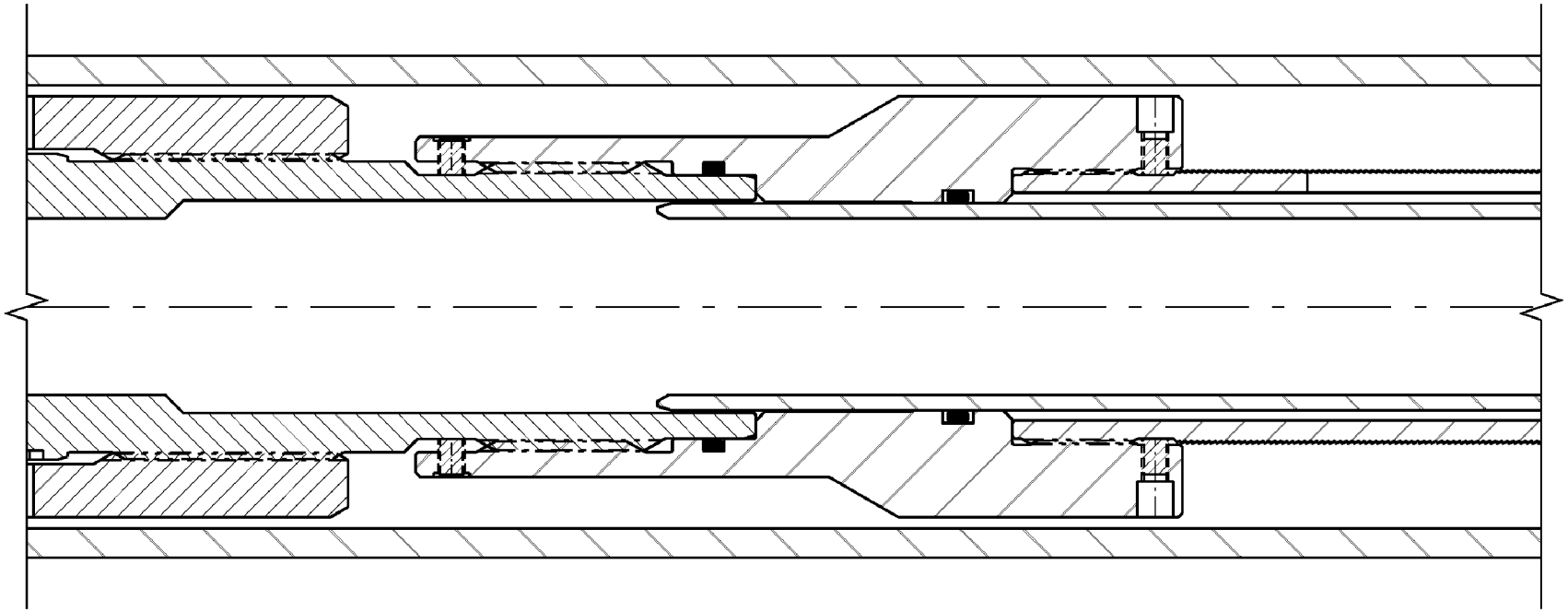

Before wrapping up the operation of this preferred embodiment, an alternative embodiment shown in a single run in position in FIG. 12 will be discussed in a shorthand manner since there are many operational similarities and fewer differences. The FIG. 12 design works in smaller sizes where the push out force on a mandrel assembly 300 when released from liner 306 when dogs 302 are undermined is defined by virtually the entire inside diameter of the liner 306 at seal 304, as shown in FIG. 12*c*. It will also be noted that the piston assembly 308 shown in FIGS. 12*i*-*k* is still referenced on one side to passage 310 but on the opposite side 312 is referenced to annular space 314 between the mandrel assembly 300 and the liner 306. Looking at FIGS. 12*n*-12*p*, there is no liner supported packoff and the wiper plug 316 does not prevent pressure from equalizing between passage 318 and annular space 314.

In operation a ball (not shown) is landed on seat 320 shown in FIG. 12*j*. Pressure in passage 310 moves the piston assembly 308 and pushes out slips 322 to grab the liner 306 internally with the mandrel assembly 300. Latch assembly 324 shown in FIG. 12*f* is released so that one or more pistons 326 with only one shown can then advance the swage assembly 328, see FIGS. 12*e* and 12*h*. The expansion with the swage assembly 328 sets the anchor 330, shown in FIG. 12*h*, to support the liner 306 to the surrounding tubular, not shown. The movement of the piston or pistons 326 also undermines dogs 302 shown in FIG. 12*c* so that the mandrel assembly 300 is released from the liner 306. What follows is a set down of weight to release the slips 322 and re-cock the stroke of piston or pistons 326. The mandrel assembly is raised up to confirm release of dogs 302 from the liner 306. After setting down weight the cementing process takes place in a known manner including the launching of wiper plug 316.

Figure 12M:
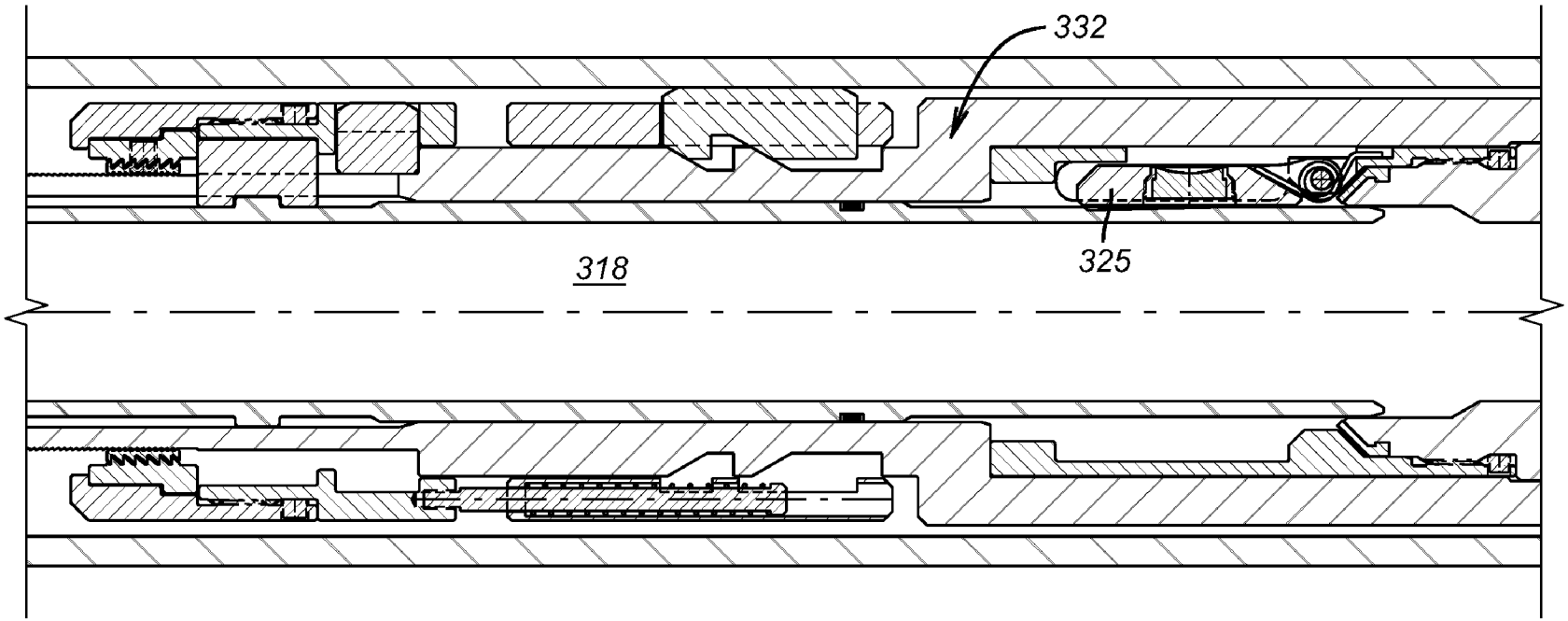
Figure 12N:
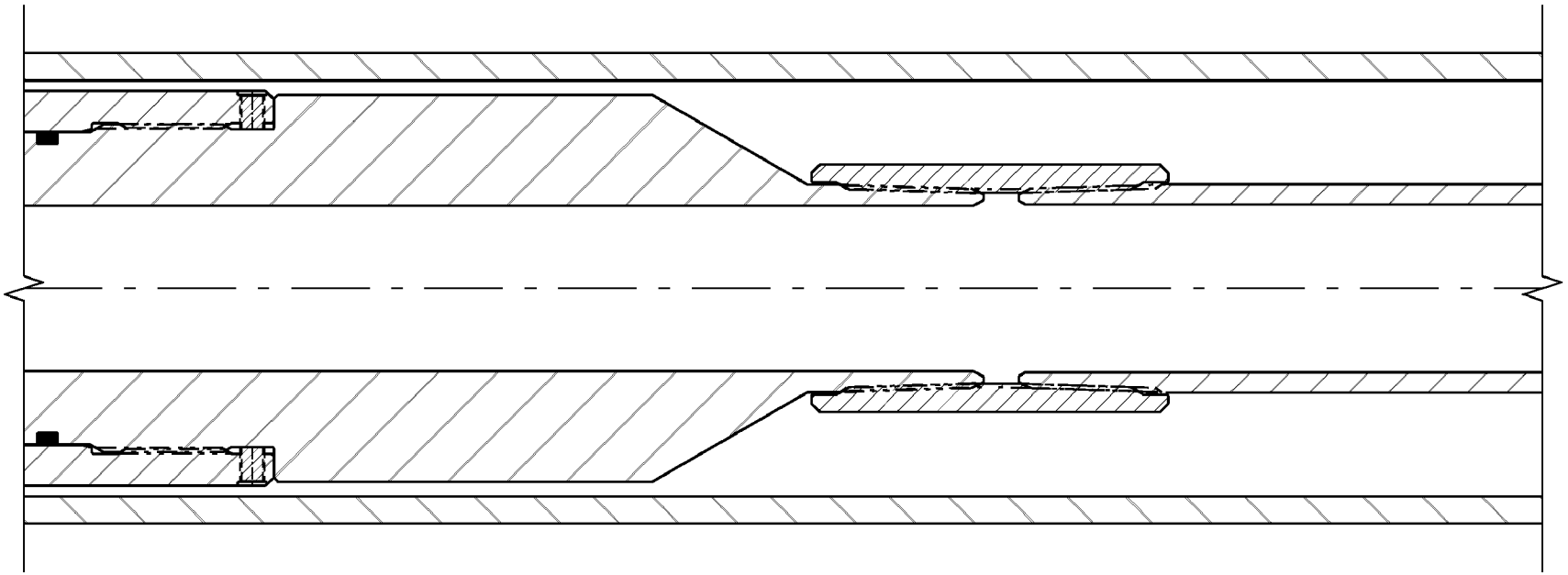
Figure 12O:
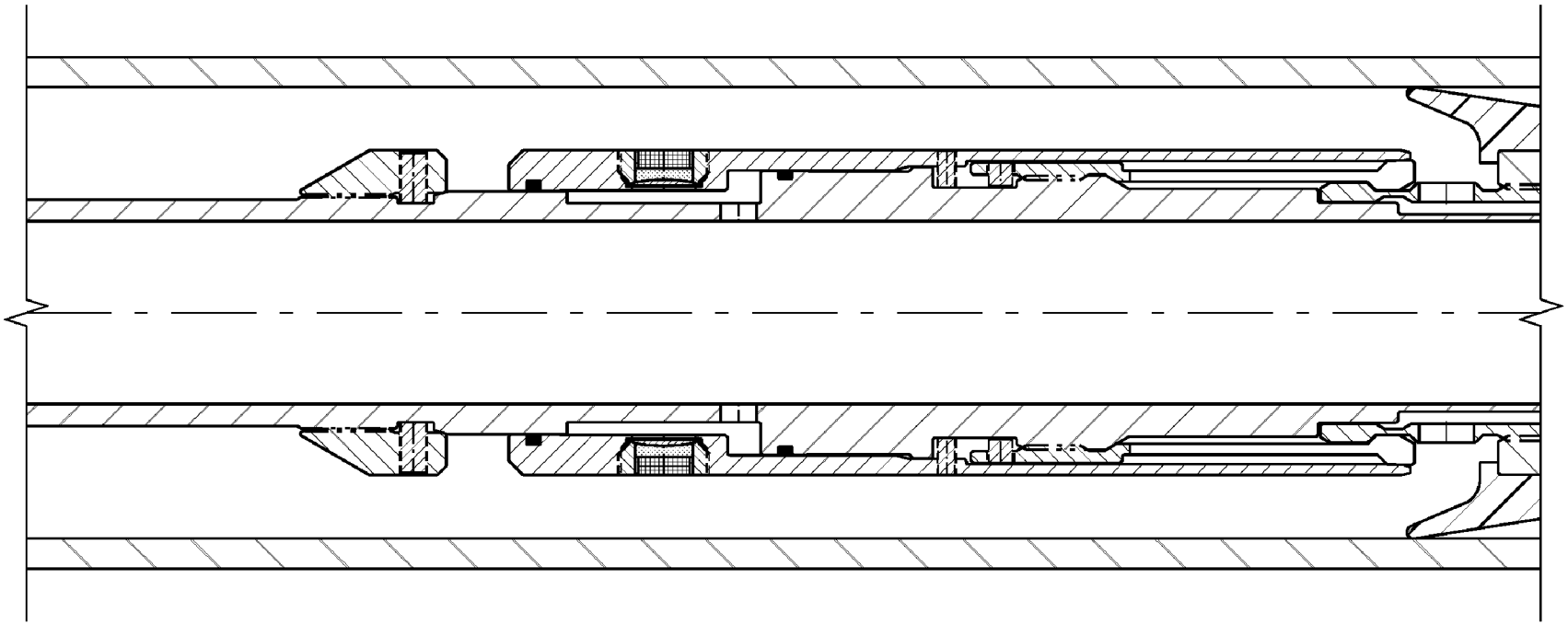
Figure 12P:
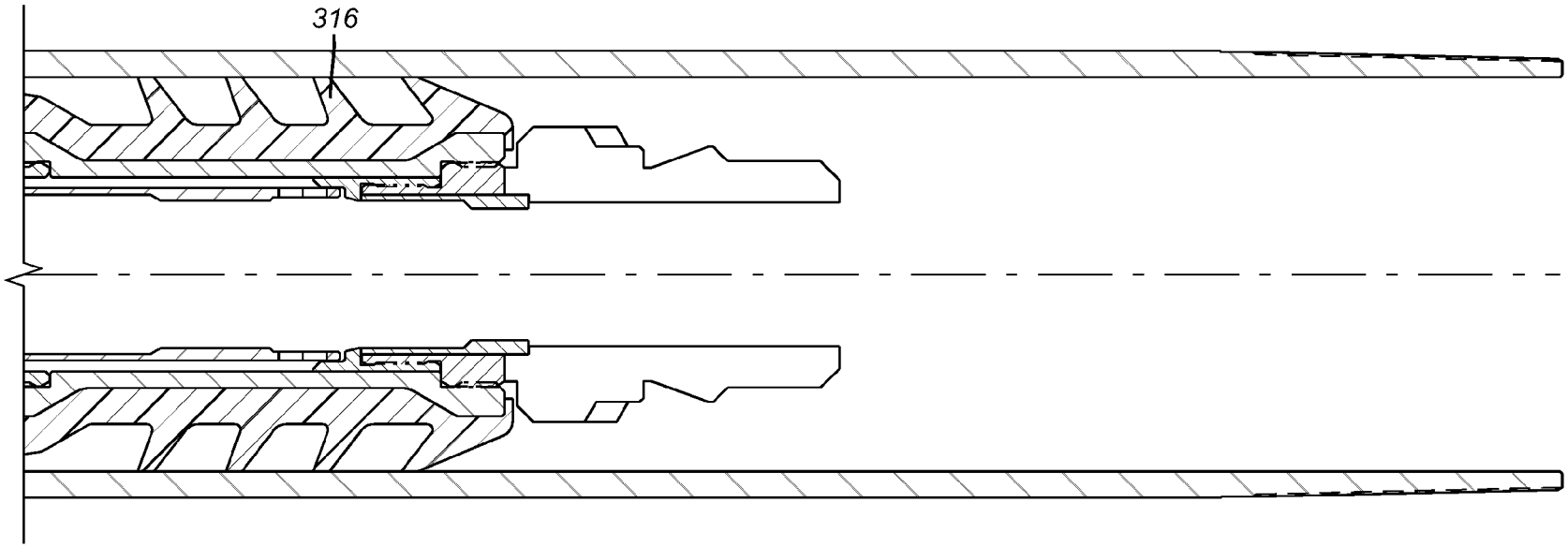

The mandrel assembly is picked up further than the previous time to allow the flapper assembly 332 shown in FIG. 12*m* to gain temporary support in the now expanded portion of liner 306 so that setting down weight will release the flapper 325 in the manner previously described for the other embodiment, so that passage 318 will be closed again. The passage 318 is pressured up and the slips 322 get another bite and the piston or pistons 326 stroke the swage assembly 328 as described before. Note that only one passage 310 is used to pressure up the piston assembly 308 because it is referenced to the annular space 314. The other design was referenced to the passage in the mandrel assembly in two places straddling the ball seat. In that design when the flapper was released it was then necessary to close one of the passages to unbalance the piston. In this design, with the flapper 325 closing passage 318 below passage 310 all that needs to happen to move the piston assembly is pressure in passage 310. Note further that there is no annular barrier other than seal 304 which is above the piston assembly 308. This makes the outer diameter of the mandrel assembly 300 a piston area for a push out force from fluid pumping through the mandrel assembly. However since the size of the tool is generally about 8 inches or less the string weight and applied load from the rig can offset this generated push out force.

In any event, re-pressurizing the passage 318 now sets the seal 334 shown in FIG. 12*i*. After that weight is set down to release the slips 322 and the tool is pulled out.

Those skilled in the art will appreciate that a one trip operation to hang and set a liner and cement it is made possible including a release after supporting the liner by an initial expansion and before cementing takes place. The tool can be lifted to verify the release of the liner before cementing. The expansion can continue with blockage of the passage in the running tool which coincides with closure of a balance port below the ball seat so that the piston assembly is unbalanced in the design with an annular packoff down below that reduces the push out force because it is releasably engaged to the liner while sealed against the mandrel assembly of the running tool. In the smaller size with a seal 304 near the top of the running tool, the outer dimension of the running tool is the piston area for a push out force and there is no annular packoff down below. In both embodiments, expansion in two stages occurs and release from the running tool accompanies the first expansion. This release makes it possible to confirm the release before cementing followed by a second stage expansion to seal the already supported liner.

The above description is illustrative of the preferred embodiment and many modifications may be made by those skilled in the art without departing from the invention whose scope is to be determined from the literal and equivalent scope of the claims below.

We claim:

1. A one trip method of extending a borehole while advancing a first tubular through an existing tubular and cementing and securing the first tubular downhole to the existing tubular, comprising:

extending a borehole past the existing tubular with a bit mounted to the first tubular while the first tubular is supported on a running tool;

selectively supporting said first tubular from said running tool at the desired location adjacent said existing tubular;

expanding said first tubular into a supporting relation with said existing tubular;

releasing said selective supporting of said first tubular from said running tool after said expanding;

cementing said first tubular only after said releasing;

sealing the first tubular to the existing tubular after said cementing with further expanding said first tubular;

removing the running tool.

2. The method of claim 1, wherein, said expanding further comprising initially expanding to support said first tubular without sealing it to the existing tubular;

subsequently expanding after cementing to seal the first tubular to the existing tubular.

3. The method of claim 2, comprising:

grabbing said first tubular internally with a slip actuated from said running tool;

moving a swage to accomplish said initially expanding;

accomplishing said releasing due to moving said swage.

4. A one trip method of extending a borehole while advancing a first tubular through an existing tubular and cementing and securing the first tubular downhole to the existing tubular, comprising:

extending a borehole past the existing tubular with a bit mounted to the first tubular while the first tubular is supported on a running tool;

selectively supporting said first tubular from said running tool at the desired location adjacent said existing tubular;

expanding said first tubular into a supporting relation with said existing tubular;

releasing said selective supporting of said first tubular from said running tool after said expanding;

cementing said first tubular only after said releasing;

sealing the first tubular to the existing tubular after said cementing;

removing the running tool;

said expanding further comprising initially expanding to support said first tubular without sealing it to the existing tubular;

subsequently expanding after cementing to seal the first tubular to the existing tubular; grabbing said first tubular internally with a slip actuated from said running tool;

moving a swage to accomplish said initially expanding;

accomplishing said releasing due to moving said swage;

providing a piston assembly initially in pressure balance to fluids in a passage in said running tool as the actuating mechanism for said slip;

initially obstructing said passage to unbalance said piston assembly when pressure is applied to the obstructed passage;

moving said piston assembly to set said slip.

5. A one trip method of cementing and securing a first tubular downhole to an existing tubular, comprising:

selectively supporting said first tubular from a running tool at the desired location adjacent said existing tubular;

expanding said first tubular into a supporting relation with said existing tubular;

releasing said selective supporting of said first tubular from said running tool after said expanding;

cementing said first tubular only after said releasing;

sealing the first tubular to the existing tubular after said cementing; removing the running tool;

said expanding further comprising initially expanding to support said first tubular without sealing it to the existing tubular;

subsequently expanding after cementing to seal the first tubular to the existing tubular;

grabbing said first tubular internally with a slip actuated from said running tool; moving a swage to accomplish said initially expanding;

accomplishing said releasing due to moving said swage;

providing a piston assembly initially in pressure balance to fluids in a passage in said running tool as the actuating mechanism for said slip;

initially obstructing said passage to unbalance said piston assembly when pressure is applied to the obstructed passage;

moving said piston assembly to set said slip;

providing ports to opposed sides of said piston assembly from said passage;

blocking one of said ports with an object landing on a seat in said passage;

pressurizing the remaining port to drive said piston assembly.

6. The method of claim 5, comprising:

unlocking said swage for movement after moving said piston assembly to set said slip.

7. The method of claim 6, comprising:

using swage movement to release said running tool from said first tubular.

8. The method of claim 7, comprising:

using force multiplying pistons to drive said swage with said passage initially obstructed;

clearing said passage after said initially expanding.

9. The method of claim 7, comprising:

picking up said running tool a first distance after said initially expanding to confirm release from said first tubular;

setting down said running tool after said picking up to perform said cementing.

10. The method of claim 9, comprising:

picking up said running tool a second distance after said cementing;

supporting, due to said picking up a second distance, an obstruction release device on a taper in said first tubular created by said initially expanding;

releasing said obstruction release device to block said passage a second time.

11. The method of claim 10, comprising:

blocking one of said ports from said passage to said piston assembly as a result of said blocking said passage a second time;

actuating said piston assembly to perform said subsequent expansion that seals said first tubular to the existing tubular;

clearing said passage a second time before said removal of said running tool.

12. The method of claim 11, comprising:

removing with said running tool an annular barrier between said running tool said first tubular from support by said first tubular.

13. A one trip method of extending a borehole while advancing a first tubular through an existing tubular and cementing and securing the first tubular downhole to the existing tubular, comprising:

extending a borehole past the existing tubular with a bit mounted to the first tubular while the first tubular is supported on a running tool;

selectively supporting said first tubular from a running tool at the desired location adjacent said existing tubular;

expanding said first tubular into a supporting relation with said existing tubular;

releasing said selective supporting of said first tubular from said running tool after said expanding;

cementing said first tubular only after said releasing;

sealing the first tubular to the existing tubular after said cementing;

removing the running tool;

said expanding further comprising initially expanding to support said first tubular without sealing it to the existing tubular;

subsequently expanding after cementing to seal the first tubular to the existing tubular;

picking up said running tool a first distance after said initially expanding to confirm release from said first tubular;

setting down said running tool after said picking up to perform said cementing.

14. A one trip method of cementing and securing a first tubular downhole to an existing tubular, comprising:

selectively supporting said first tubular from a running tool at the desired location adjacent said existing tubular;

expanding said first tubular into a supporting relation with said existing tubular;

releasing said selective supporting of said first tubular from said running tool after said expanding;

cementing said first tubular only after said releasing;

sealing the first tubular to the existing tubular after said cementing;

removing the running tool;

said expanding further comprising initially expanding to support said first tubular without sealing it to the existing tubular;

subsequently expanding after cementing to seal the first tubular to the existing tubular; selectively blocking a passage in said running tool each time to perform said initial and said subsequent expanding;

providing ports to opposed sides of said piston from said passage;

moving a piston assembly with pressure in said passage when it is selectively blocked between said ports or when said passage is blocked at another location with one port also blocked; and sequentially performing at least the first two operations of grabbing the first tubular with a slip extended by said piston, releasing a swage to move and releasing said running tool from said first tubular.

15. The method of claim 14, comprising:

sequentially performing all three operations the first time said passage is blocked between said port and before said cementing; and sequentially performing the first two operations the second time said passage is blocked at said another location with one said port blocked and after said cementing.

16. The method of claim 14, comprising:

blocking said passage the first time with an object that lands to seal on a seat surrounding said passage and then gets blown through said seat;

blocking said passage a second time by releasing, with movement of said running tool after said cementing, a valve to close said passage.

17. A one trip method of extending a borehole while advancing a first tubular through an existing tubular and cementing and securing the first tubular downhole to the existing tubular, comprising:

extending a borehole past the existing tubular with a bit mounted to the first tubular while the first tubular is supported on a running tool;

selectively supporting said first tubular from a running tool at the desired location adjacent said existing tubular;

expanding said first tubular into a supporting relation with said existing tubular;

releasing said selective supporting of said first tubular from said running tool after said expanding;

cementing said first tubular only after said releasing;

sealing the first tubular to the existing tubular after said cementing;

removing the running tool;

said expanding further comprising initially expanding to support said first tubular without sealing it to the existing tubular;

subsequently expanding after cementing to seal the first tubular to the existing tubular;

providing a piston assembly initially in pressure balance to fluids in a passage in said running tool as the actuating mechanism for a slip;

providing ports to opposed sides of said piston assembly from said passage;

selectively blocking said passage a first time between said ports to unbalance said piston to pressure in said passage for moving said slip;

selectively blocking said passage a second time at another location and unbalancing said piston by blocking one of said ports.

18. A one trip method of cementing and securing a first tubular downhole to an existing tubular, comprising:

selectively supporting said first tubular from a running tool at the desired location adjacent said existing tubular;

expanding said first tubular into a supporting relation with said existing tubular;

releasing said selective supporting of said first tubular from said running tool after said expanding;

cementing said first tubular only after said releasing;

sealing the first tubular to the existing tubular after said cementing;

removing the running tool;

said expanding further comprising initially expanding to support said first tubular without sealing it to the existing tubular;

subsequently expanding after cementing to seal the first tubular to the existing tubular;

providing a piston assembly initially in pressure balance to fluids in a passage in said running tool as the actuating mechanism for a slip;

providing ports to opposed sides of said piston assembly from said passage;

selectively blocking said passage a first time between said ports to unbalance said piston to pressure in said passage for moving said slip;

selectively blocking said passage a second time at another location and unbalancing said piston by blocking one of said ports;

accomplishing the blocking of one of said ports by said selective blocking of said passage a second time.

19. A one trip method of extending a borehole while advancing a first tubular through an existing tubular and cementing and securing the first tubular downhole to the existing tubular, comprising:

extending a borehole past the existing tubular with a bit mounted to the first tubular while the first tubular is supported on a running tool;

selectively supporting said first tubular from a running tool at the desired location adjacent said existing tubular;

expanding said first tubular into a supporting relation with said existing tubular;

releasing said selective supporting of said first tubular from said running tool after said expanding;

cementing said first tubular only after said releasing;

sealing the first tubular to the existing tubular after said cementing;

removing the running tool;

supporting an annular barrier from within said first tubular that is located to selectively block an annular space between said running tool and said first tubular;

limiting a push out piston area on said running tool to the running tool outside dimension at said annular barrier.

20. A one trip method of cementing and securing a first tubular downhole to an existing tubular, comprising:

selectively supporting said first tubular from a running tool at the desired location adjacent said existing tubular;

expanding said first tubular into a supporting relation with said existing tubular;

releasing said selective supporting of said first tubular from said running tool after said expanding;

cementing said first tubular only after said releasing;

sealing the first tubular to the existing tubular after said cementing; removing the running tool;

supporting an annular barrier from within said first tubular that is located to selectively block an annular space between said running tool and said first tubular;

limiting a push out piston area on said running tool to the running tool outside dimension at said annular barrier;

providing a piston on said running tool to actuate a slip to selectively retain said running tool to said first tubular for performing said expanding;

positioning said annular barrier further downhole from said piston;

referencing opposed ends of said piston to a passage within said running tool for pressure balance of said piston to avoid pressure imbalance between said passage within said running tool and said annular space around said running tool.

21. A one trip method of cementing and securing a first tubular downhole to an existing tubular, comprising:

selectively supporting said first tubular from a running tool at the desired location adjacent said existing tubular;

expanding said first tubular into a supporting relation with said existing tubular;

releasing said selective supporting of said first tubular from said running tool after said expanding;

cementing said first tubular only after said releasing;

sealing the first tubular to the existing tubular after said cementing; removing the running tool;

providing a piston on said running tool to actuate a slip to selectively retain said running tool to said first tubular for performing said expanding;

positioning said annular barrier further downhole from said piston;

referencing opposed ends of said piston to a passage within said running tool for pressure balance of said piston to avoid pressure imbalance between said passage within said running tool and said annular space around said running tool.

* * * * *